US007603869B2

(12) United States Patent
Kim et al.

(10) Patent No.: US 7,603,869 B2
(45) Date of Patent: Oct. 20, 2009

(54) REFRIGERATOR HAVING DISPENSER

(75) Inventors: Seong-Ook Kim, Jinju (KR); Ill-Shin Kim, Changwon (KR); Si-Yeon An, Gimhae (KR); Dong-Yeol Yoo, Seoul (KR); Oh-Chul Kwon, Changwon (KR); Bum-Sik Lee, Busan (KR); Joo-Won Park, Changwon (KR)

(73) Assignee: LG Electronics Inc., Seoul (KR)

( * ) Notice: Subject to any disclaimer, the term of this patent is extended or adjusted under 35 U.S.C. 154(b) by 285 days.

(21) Appl. No.: 10/580,234

(22) PCT Filed: Nov. 26, 2004

(86) PCT No.: PCT/KR2004/003075

§ 371 (c)(1),
(2), (4) Date: May 22, 2006

(87) PCT Pub. No.: WO2005/052477

PCT Pub. Date: Jun. 9, 2005

(65) Prior Publication Data

US 2007/0144203 A1 Jun. 28, 2007

(30) Foreign Application Priority Data

| | | |
|---|---|---|
| Nov. 28, 2003 | (KR) | 10-2003-0085659 |
| Nov. 28, 2003 | (KR) | 10-2003-0085660 |
| Nov. 28, 2003 | (KR) | 10-2003-0085661 |
| Nov. 28, 2003 | (KR) | 10-2003-0085662 |
| Nov. 28, 2003 | (KR) | 10-2003-0085663 |
| Nov. 28, 2003 | (KR) | 10-2003-0085664 |
| Nov. 28, 2003 | (KR) | 10-2003-0085665 |
| Nov. 28, 2003 | (KR) | 10-2003-0085667 |
| Nov. 28, 2003 | (KR) | 10-2003-0085669 |
| Nov. 28, 2003 | (KR) | 10-2003-0085670 |
| Nov. 28, 2003 | (KR) | 10-2003-0085671 |
| Nov. 28, 2003 | (KR) | 10-2003-0085684 |
| Dec. 5, 2003 | (KR) | 10-2003-0088235 |

(51) Int. Cl.
*F25D 23/12* (2006.01)

(52) U.S. Cl. ..... 62/129; 62/338; 62/389

(58) Field of Classification Search ..... 62/125–129, 62/338–339, 389–390
See application file for complete search history.

(56) References Cited

U.S. PATENT DOCUMENTS 1,220,783 A * 3/1917 Ranney ..... 62/338

(Continued)

FOREIGN PATENT DOCUMENTS

JP 06-159918 6/1994

(Continued)

OTHER PUBLICATIONS

Korean Office Action for 2006-031790114 dated May 30, 2006.

(Continued)

*Primary Examiner*—William E Tapolcai
(74) *Attorney, Agent, or Firm*—KED & Associates, LLP

(57) ABSTRACT

The present invention relates to a refrigerator having a dispenser. In the present invention, the dispenser is provided in a concave portion of a door to be exposed toward a front surface of the door. A water tank is installed between a rear surface of the dispenser and a door liner defining a rear surface of the door. The water tank stores the water delivered from an external water supply source while the water in maintained at a relatively low temperature and then discharges the water to the outside through the dispenser. Furthermore, in the present invention, a nozzle, through which the water is discharged from the water tank, is directly connected to a drainpipe of the dispenser, so that users may always take out the water maintained at a constant temperature.

15 Claims, 16 Drawing Sheets

U.S. PATENT DOCUMENTS

| | | | | | |
|---|---|---|---|---|---|
| 2,020,963 | A | * | 11/1935 | Reid | 222/183 |
| 2,030,291 | A | * | 2/1936 | Fuller | 62/338 |
| 2,078,097 | A | * | 4/1937 | Radzinsky | 222/182 |
| 2,126,491 | A | * | 8/1938 | McCartha | 222/182 |
| 2,408,704 | A | * | 10/1946 | Taylor | 222/160 |
| 3,208,641 | A | * | 9/1965 | Brugioni | 222/108 |
| 4,739,629 | A | | 4/1988 | True | 62/338 |
| 4,866,949 | A | * | 9/1989 | Rudick | 62/307 |
| 5,096,095 | A | * | 3/1992 | Burton | 222/173 |
| 5,971,213 | A | * | 10/1999 | Lee | 222/146.6 |
| 6,079,221 | A | | 6/2000 | Senner | 62/338 |

FOREIGN PATENT DOCUMENTS

| | | |
|---|---|---|
| KR | 10-1998-0022736 | 7/1998 |
| KR | 10-0153159 | 7/1998 |
| KR | 10-1999-0026165 | 4/1999 |
| KR | 2000-0002573 | 2/2000 |
| KR | 2000-0007929 | 2/2000 |
| KR | 2000-0014608 | 3/2000 |
| KR | 10-2000-0040288 | 7/2000 |
| KR | 10-2003-0031764 | 4/2003 |

OTHER PUBLICATIONS

Korean Office Action for 2006-031790260 dated May 30, 2006.

Korean Office Action for 2006-031800790 dated May 30, 2006.

Korean Office Action for 2006-070817342 dated Nov. 29, 2006.

Korean Office Action for 2007-006789474 dated Feb. 2, 2007.

English-language translation of Mexican Office Action dated Apr. 8, 2009.

* cited by examiner

REFRIGERATOR HAVING DISPENSER

TECHNICAL FIELD

The present invention relates to a refrigerator, and more particularly, to a refrigerator having a dispenser for allowing water to be supplied from a water tank, which is connected to an external water supply source and supplied with water, and to be discharged to the outside.

BACKGROUND ART

FIG. 1 shows a refrigerator having a dispenser according to a prior art. According to this, a front surface of a refrigerator main body 1 in which freezing and refrigerating chambers are defined is mounted with doors 2 and 3 for selectively opening and closing the freezing and refrigerating chambers.

The refrigerator main body 1 is provided with a valve 4 for controlling water supply from an external water supply source (not shown). The valve 4 is connected to first and second supply pipes 5 and 5' and then supplies a dispenser 7 and an ice maker 8 with the water supplied from the water supply source. In the middle of the first supply pipe 5, a water tank 6 is provided. The water tank 6 is installed in the refrigerating chamber. The water tank 6 holds water and then supplies it to the dispenser 7.

The dispenser 7 is generally provided in the door 2 for the freezing chamber, whereas the first supply pipe 5 passes through the refrigerator main body 1 and the interior of the door 2 and then is connected to the dispenser 7.

However, the configuration of the above prior art has the following problems.

The water in the water tank 6 is maintained at the substantially same temperature as the interior of the refrigerating chamber, and the water so maintained is supplied to the dispenser 7 through the first supply pipe 5. The first supply pipe 5 for supplying the water to the dispenser 7 is configured so as to pass through the door 2 of the freezing chamber side. Then, when passing through the interior of the door 2, the first supply pipe 5 is arranged adjacent to a front surface of the door 2 which is mainly manufactured of metal plate.

For reference, the temperature of the water discharged from the dispenser 7 depends on the temperature of the water in the water tank 6 that is based on the temperature of the refrigerating chamber. However, the first cup of water discharged through the dispenser 7 is generally what has been remained in the first supply pipe 5. Thus, if the dispenser 7 has not been used for a long time, the water in the first supply pipe 5 positioned in the door 2 which is relatively under the influence of the external temperature of the refrigerator is supplied. Thus, there is a problem in that the water with relatively high temperature is supplied to users through the dispenser 7.

In addition, in the prior art, since the valve 4 is installed to a rear end of the refrigerator main body 1, a machine room or the like, there is a problem in that the refrigerator main body 1 should be moved for the maintenance of the valve 4. It is the same as a filter for filtering impurities from water.

DISCLOSURE

[Technical Problem]

An object of the present invention is to provide a refrigerator having a dispenser capable of keeping the temperature of water at a low temperature state even when the dispenser has not been used for a long time.

Another object of the present invention is to smoothly form a foam layer when a door is mounted with a water tank for supplying water to a dispenser.

A further object of the present invention is to smoothly form an insulating layer in a door of a refrigerator in which the door is provided with a dispenser and a water tank.

A still further object of the present invention is to make it possible to precisely detect the temperature of water in a water tank of a refrigerator in which the door is provided with a dispenser and a water tank.

A still further object of the present invention is to precisely install a water tank in a door.

A still further object of the present invention is to securely install a water tank in an insulating layer formed in a door A still further object of the present invention is to prevent the water in a water tank provided in a door from splattering through a nozzle when the door is opened and closed.

A still further object of the present invention is to make it easy to connect a water tank and a drainpipe of a dispenser to each other.

A still further object of the present invention is to make it possible to always keep the water in a water tank at the appropriate temperature and to maintain the predetermined or more storage capacity of a refrigerator, when the water tank is installed in a door.

A still further object of the present invention is to install to a door a water tank, a valve and the like for supplying a dispenser with water.

A still further object of the present invention is to install a water tank in a door to enable maintenance and to supply water to a dispenser.

A still further object of the present invention is to supply water to a dispenser by using a tube installed in a door as a reservoir without manufacturing an additional water tank.

A still further object of the present invention is to make it possible to maximize an internal storage space with a dispenser provided.

[Technical Solution]

According to an aspect of the present invention for achieving the objects, there is provided a refrigerator including a main body formed with a storage space and a door formed with an insulating layer therein and mounted to the main body for selectively opening and closing the storage space. The refrigerator comprises: a dispenser including a dispenser housing installed in a concave portion of a front surface of the door and discharging water/ice to the outside; a water tank which is installed between a door liner defining a rear surface of the door and the dispenser housing to be spaced apart by a predetermined gap from each of them, stores the water supplied from an external water supply source at a predetermined temperature and then provides the water to the dispenser; and a heater which is installed adjacent to the water tank and selectively generates heat.

A rear surface of the dispenser housing may be shaped in a curved surface, and a front surface of the water tank may be shaped in a curved surface corresponding to the rear surface of the dispenser housing, thus causing the front surface of the water tank to be spaced apart by a predetermined interval from the rear surface of the dispenser housing.

The refrigerator may further comprise a temperature sensor which detects a temperature of the water stored in the water tank and which is provided on an external surface of the water tank.

The front surface of the door may further comprise a display through which the temperature of the water in the water tank detected in the temperature sensor is displayed.

The temperature sensor may be seated in a sensor groove, which is concavely formed in the external surface of the water tank.

The sensor groove may be formed at a position facing the storage space when the water tank is installed in the interior of the door.

The water tank may be fastened to a support rib, which is extended from and formed on a rear surface of the dispenser housing and thus fixed to the interior of the door.

The water tank may be formed with a fastening rib at a position corresponding to the support rib of the dispenser housing, and fixed to the interior of the door by fastening the fastening rib to the support rib.

A tank main body of the water tank may be formed with a through-hole through which foam liquid forming the insulating layer flows.

A plurality of the through-holes may be bored through thinner portions of the tank main body.

The water tank may comprise a tank main body in which the water is stored, a neck formed integrally with the tank main body and having a relatively narrow flow sectional area, and a nozzle installed to the neck, injection-molded and connected to a drainpipe of the dispenser, so that the tank main body and the neck are formed by a blow molding with the nozzle inserted therein.

A flow sectional area of the nozzle may be formed relatively narrower than that of the neck.

The water tank may be bent and formed to conform to a rear surface of the dispenser housing and at least a surface of the dispenser housing adjacent thereto, and bent and formed so that a portion getting out of the rear surface of the dispenser housing is spaced apart by a predetermined interval from the dispenser housing.

The water tank may be bent and formed so that the water tank is spaced apart by a predetermined interval from the rear surface and a lower surface of the dispenser housing, and installed in the interior of the door.

The heater may be installed on a rear surface of the dispenser housing.

The heater may selectively apply heat to the water of the water tank, thus keeping the water at a predetermined temperature, while the heater may apply heat to a surface of the dispenser housing, thus preventing frostiness.

A valve chamber may be further formed in the insulating layer of the door to be opened to the storage space of the refrigerator main body, and include a valve for controlling the water supply from the external water supply source and a filter for purifying the water.

The valve chamber may be selectively sheltered by a chamber cover.

The water tank may be installed in the interior of the door corresponding to a rear portion of the dispenser, and sheltered by an openable and closable cover, thus being not under the influence of cold air in the storage space.

The cover may be formed with a cover insulating layer.

According to another aspect of the present invention, there is provided a refrigerator including a main body formed with a storage space and a door formed with an insulating layer therein and mounted to the main body for selectively opening and closing the storage space. The refrigerator comprises: a dispenser including a dispenser housing installed in a concave portion of a front surface of the door and discharging water/ice to the outside; a water tank which is installed between a door liner defining a rear surface of the door and the dispenser housing to be spaced apart by a predetermined gap from each of them, stores the water supplied from an external water supply source at a predetermined temperature and then provides the water to the dispenser; and a filter purifying the water delivered from the external water supply source and supplying the water to the water tank.

A support rib may protrude from and be formed on a rear surface of the dispenser housing, a fastening rib may be formed on the water tank at a position corresponding to the support rib, and the water tank may be fixed to the interior of the door to be spaced apart by a predetermined interval from the door liner by engaging the support rib and the fastening rib to each other.

A tank main body of the water tank may be formed with a through-hole through which foam liquid flows.

A plurality of the through-holes may be bored through thinner portions of the tank main body.

The water tank may comprise a tank main body in which the water is stored, a neck formed integrally with the tank main body and having a relatively narrow flow sectional area, and a nozzle installed to the neck, injection-molded and connected to a drainpipe of the dispenser, so that the tank main body and the neck are formed by a blow molding with the nozzle inserted therein.

A flow sectional area of the nozzle may be formed relatively narrower than that of the neck.

The water tank may be bent and formed to conform to a rear surface of the dispenser housing and at least a surface of the dispenser housing adjacent thereto, and bent and formed so that a portion getting out of the rear surface of the dispenser housing is spaced apart by a predetermined interval from the dispenser housing.

The water tank may be bent and formed so that the water tank is spaced apart by a predetermined interval from the rear surface and a lower surface of the dispenser housing, and is installed in the interior of the door.

A valve chamber may be further formed in the insulating layer of the door to be opened to the storage space of the refrigerator main body, and include a valve for controlling the water supply from the external water supply source and a filter for purifying the water.

The valve chamber may be selectively sheltered by a chamber cover.

The water tank may be installed in the interior of the door corresponding to a rear portion of the dispenser, and sheltered by an openable and closable cover, thus being not under the influence of cold air in the storage space.

The cover may be formed with a cover insulating layer.

According to a further aspect of the present invention, there is provided a refrigerator, a main body of which is formed with a storage space and mounted with a door for selectively opening and closing the storage space, the door being formed with an insulating layer therein. The refrigerator comprises: a dispenser including a dispenser housing installed in a concave portion of a front surface of the door and discharging water/ice to the outside; and a reservoir which is installed in the insulating layer between a door liner defining a rear surface of the door and the dispenser housing, formed by arranging a tube repeatedly in a zigzag shape, stores the water supplied from an external water supply source at a predetermined temperature, and provides the water to the dispenser.

The reservoir may be formed by arranging the tube repeatedly in a zigzag shape, wherein the tube integrally formed with a supply pipe connected to the external water supply source, and wherein the tube is directly connected to a drainpipe through which the water is discharged from the dispenser.

The reservoir may be formed by arranging the tube repeatedly in a zigzag shape, wherein the tube is separately formed from a supply pipe connected to the external water supply source, and wherein the tube is directly connected to a drainpipe through which the water is discharged from the dispenser.

The reservoir may be fixed to a support rib, which is extended from and formed on a rear surface of the dispenser housing of the dispenser.

According to a further aspect of the present invention, there is provided a refrigerator including a main body formed with a storage space and a door formed with an insulating layer therein and mounted to the main body for selectively opening and closing the storage space. The refrigerator comprises: a dispenser including a dispenser housing installed in a concave portion of a front surface of the door and discharging water/ice to the outside; a water tank which is installed between a door liner defining a rear surface of the door and the dispenser housing to be spaced apart by a predetermined gap from each of them, stores the water supplied from an external water supply source at a predetermined temperature and then provides the water to the dispenser; a temperature sensor which is installed on a side of the water tank and detects a temperature in the water tank; and a heater which operates according to the temperature in the water tank detected by the temperature sensor so that the heater generates heat when the detected temperature is lower than a preset temperature and is turned off when the detected temperature is higher than the preset temperature, thus keeping the temperature of the water tank at a predetermined value.

According to a still further aspect of the present invention, there is provided a method for manufacturing a door of a refrigerator having a dispenser. A storage space of a main body of the refrigerator is opened and closed by the door and an external appearance of the refrigerator is defined by an outer door and a door liner. The dispenser is provided in the door so that the dispenser is exposed toward the outer door. An insulating layer is installed between the outer door and the door liner so that the door liner is spaced apart by a predetermined interval from a water tank for supplying the water to the dispenser. The method comprises steps of: fixing a fastening rib of the water tank to a support rib formed on a dispenser housing of the dispenser installed in the outer door; applying foam liquid to a rear surface of the outer door while the water tank is fixed; and covering the rear surface of the outer door, to which the foam liquid is applied, with the door liner, and filling the foam liquid between the door liner and the outer door.

According to a still further aspect of the present invention, there is provided a refrigerator having a dispenser. The refrigerator comprises: a refrigerator main body including a storage space which is defined by inner and outer cases with an insulating layer formed therebetween and divided into refrigerating and freezing chambers side by side by a barrier with an insulating layer formed therein; a water tank installed in the insulating layer of the barrier to store the water delivered from a water supply source; and a dispenser installed in the storage space corresponding to the front of the water tank for providing the water delivered from water tank.

According to a still further aspect of the present invention, there is provided a refrigerator having a dispenser. The refrigerator comprises: a refrigerator main body including a storage space defined by inner and outer cases with an insulating layer formed therebetween; a water tank installed on a surface of the inner case defining an inner surface of a refrigerating chamber of the storage space to store the water delivered from a water supply source; and a dispenser installed in the storage space corresponding to the front of the water tank for providing the water delivered from water tank.

[Advantageous Effects]

According to the present invention, since the temperature of water in a water tank can be always kept constant, there are advantages in that it is possible to prevent freezing of water and frostiness on an external surface of a dispenser due to a temperature difference as well as to be supplied with water at an always constant temperature through the dispenser.

In addition, since gaps between the water tank and a heater and between a door liner and the water tank are generally kept uniform, there is also an advantage in that the water in the water tank is generally uniform in temperature due to uniform thermal conduction.

Moreover, since the water tank is kept uniformly and constantly spaced apart from peripheral parts installed in front and the rear of the water tank, it is possible to secure fluidity of foam liquid when the foam liquid is injected. Therefore, there is an advantage in that an insulating layer in the door is securely formed.

In the present invention, since a sensor groove is concavely formed on a surface of the water tank and a temperature sensor is mounted in the sensor groove, it is possible to more precisely measure the temperature in the water tank.

In the present invention, it is possible to precisely and securely install the water tank to the insulating layer in the interior of the door.

According to the present invention, since a flow sectional area of a nozzle is set to be relatively smaller than that of a tank main body or the like even though the water tank is installed in the interior of the door, the water is not splattered to the outside through the nozzle when the door is opened and closed.

In the present invention, since the nozzle is additionally injection-molded and installed to the water tank, it is possible to easily connect the water tank and a drainpipe of the dispenser to each other.

In the present invention, since the water tank is formed curvedly to conform to an external shape of a dispenser housing, it is possible to cause a rear surface of the door not to excessively protrude even though the water tank is installed in the insulating layer in the door.

In the present invention, since the water tank is installed along with a valve and a filter in the door, its maintenance can be easily made.

Moreover, in the present invention, since a supply pipe through which the water tank is connected to the valve and the filter is installed in the interior of the door, there are advantages in that a required pipe is short and breakage due to an external force is prevented.

In the present invention, there is an advantage in that the maintenance of the water tank can be made since a cover is installed on a rear surface of the door in which the water tank is installed.

In the present invention, since a reservoir having a predetermined capacity is formed in the door by bending a tube without manufacturing an additional water tank, it is possible to reduce the manufacturing costs and to prevent sediments from being produced in the reservoir.

In the present invention, it is possible to position the dispenser and the water tank in the refrigerator, to precisely keep the water in the water tank below a constant temperature when taking water out of the interior of the refrigerator and drinking it, and to maximize an internal volume of a storage space.

BEST MODE

Hereinafter, preferred embodiments of a refrigerator having a dispenser according to the present invention will be described in detail with reference to the accompanying drawings.

Figure 1:
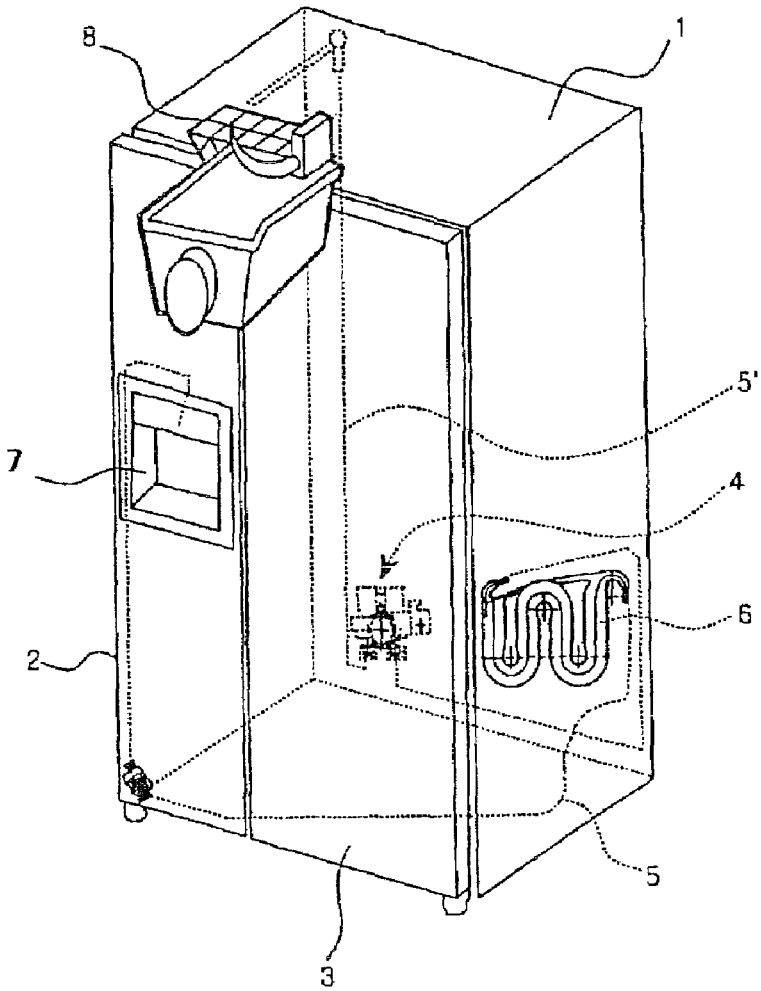
FIG. 1 PRIOR ART
FIG. 1 a partial section view schematically showing a refrigerator having a dispenser according to a prior art.
Figure 2:
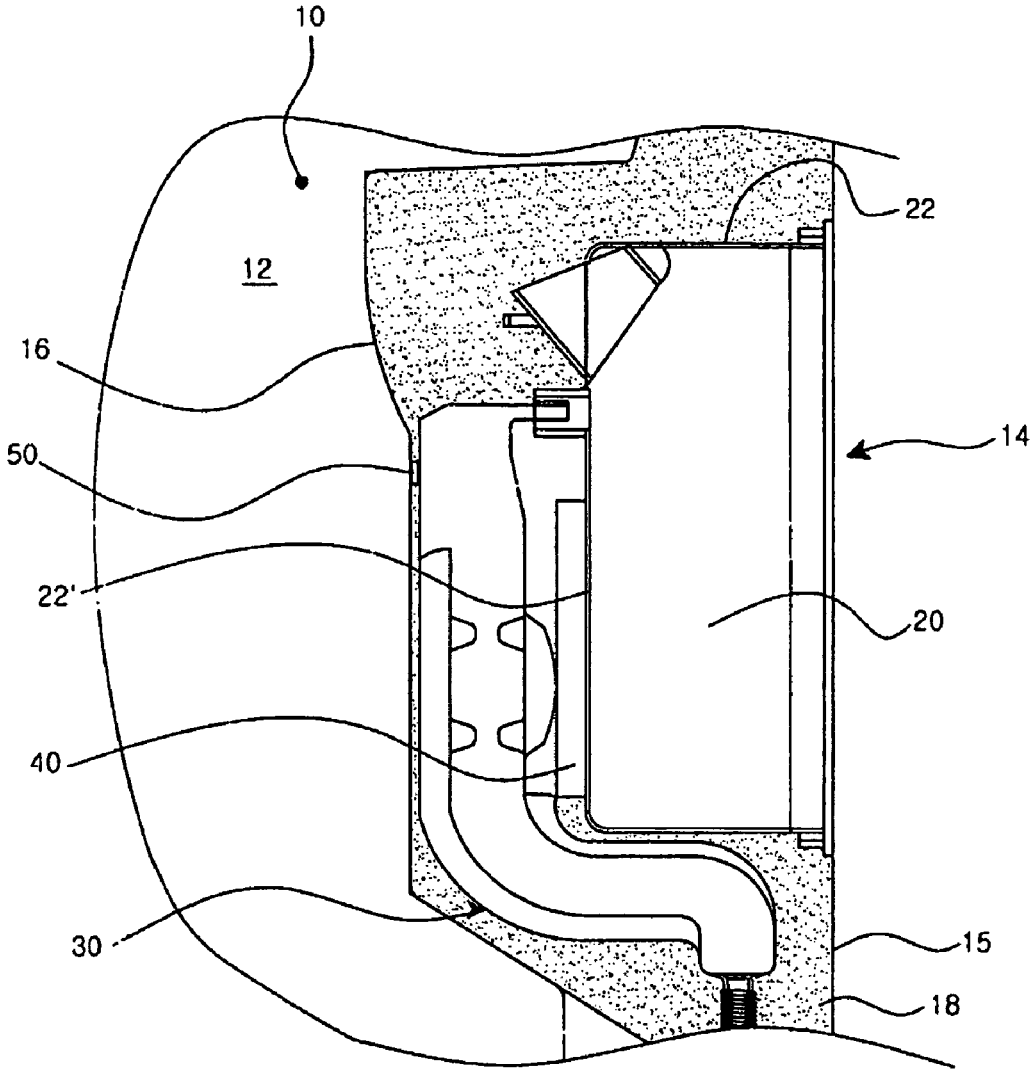
FIG. 2 is a schematic longitudinal section view showing a major portion of a first embodiment of a refrigerator having a dispenser according to the present invention.
Figure 3:
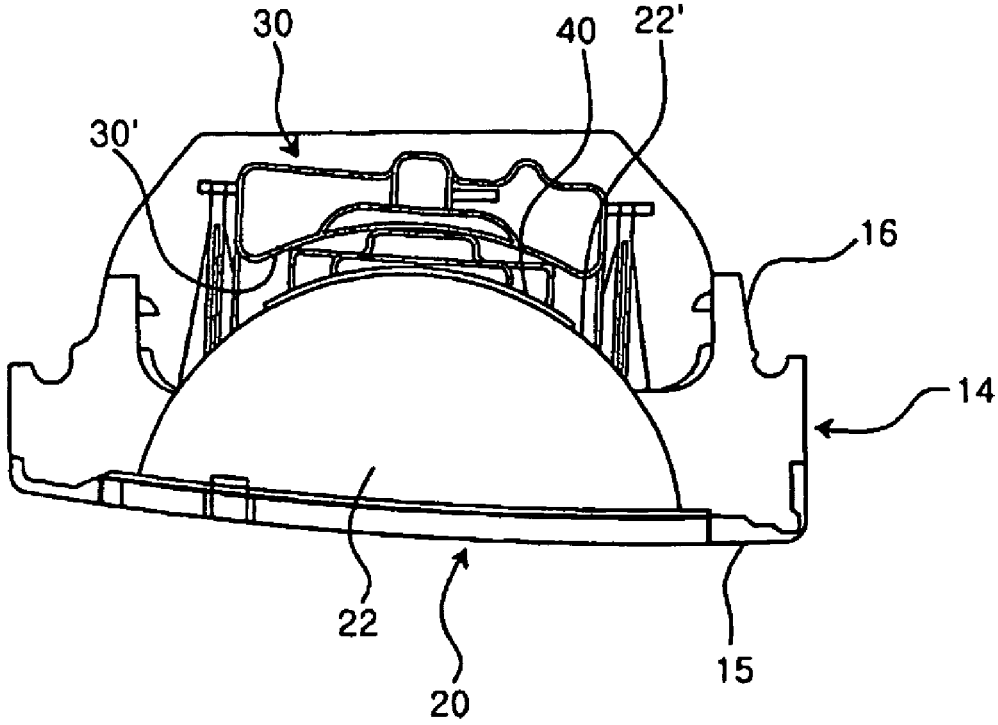
FIG. 3 is a schematic transverse section view showing the major portion of the first embodiment according to the present invention.
Figure 4:
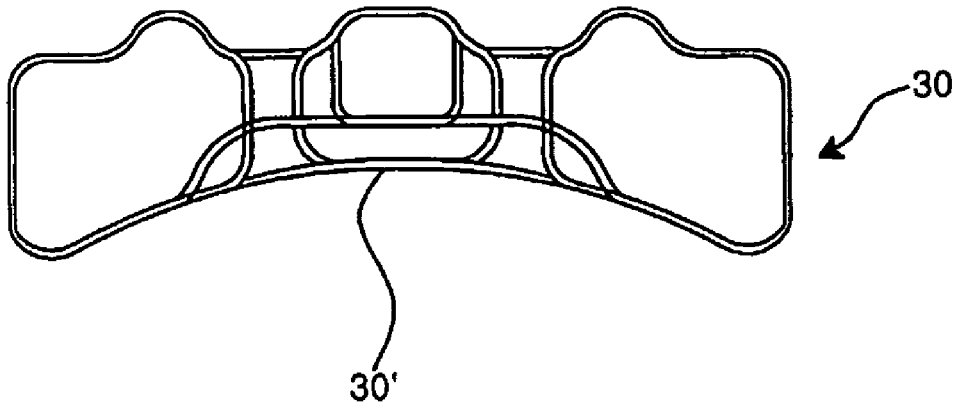
FIG. 4 is a plan view of a water tank of the first embodiment according to the present invention.
Figure 5:
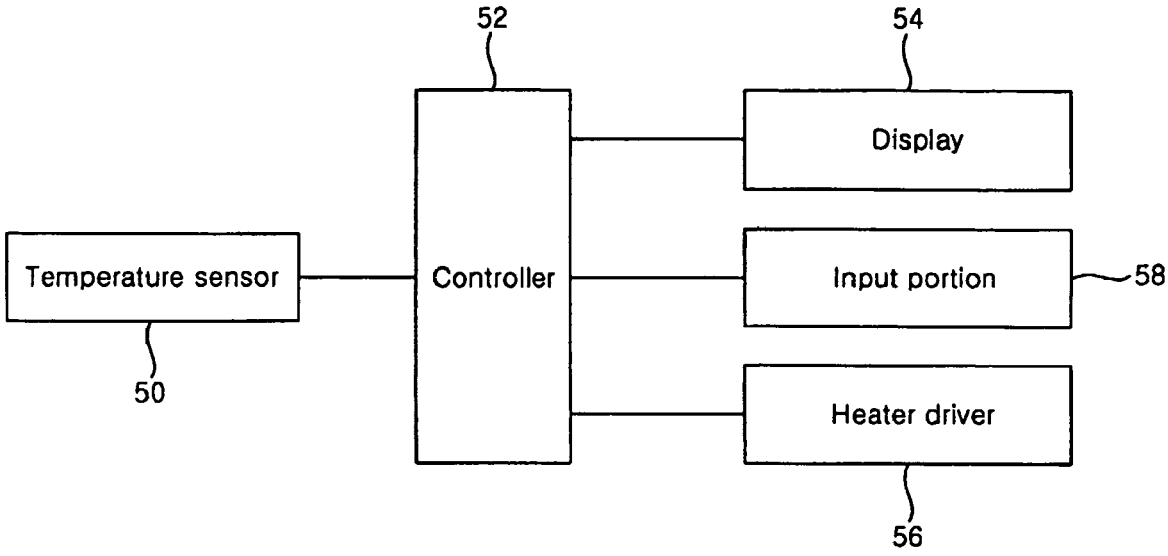
FIG. 5 is a block diagram illustrating the operation of a heater in the first embodiment according to the present invention.

As shown in FIGS. 2 to 4, a storage space 12 is formed in a refrigerator main body 10 and selectively opened and closed by a door 14. An external appearance of the door 14 is defined by an outer door 15 and a door liner 16. The door liner 16 defines a rear surface of the door 14, while the outer door 15 substantially defines the remainder of the external appearance thereof. In order to insulate the heat transfer through the door 14, an insulating layer 18 is formed in a space between the outer door 15 and the door liner 16.

A dispenser 20 is installed so that a front surface of the door 14 is exposed. It is preferred that the door 14 in which the dispenser 20 is installed be a freezing chamber door in a case where the refrigerator to which the present invention is applied is a side by side refrigerator. The detailed descriptions for the structure of the dispenser 20, through which users out of the refrigerator take out water or ice, and which is not a feature of the present invention, will not be omitted.

The dispenser 20 is provided with a dispenser housing 22. The dispenser housing 22 is shaped as a concave portion recessed into the outer door 15. In general, the dispenser housing 22 is shaped in a half cylinder.

A water tank 30 is installed between the dispenser housing 22 and the door liner 16. The water tank 30 holds the water delivered from an external water supply source and then supplies the water to the dispenser 20. The water tank 30 is provided in the insulating layer 18.

A front surface 30' of the water tank 30 facing a rear surface 22' of the dispenser housing 22 is shaped in the curved surface corresponding to the dispenser housing 22 taking the shape of a half cylinder. Therefore, a predetermined gap is formed between the dispenser housing 22 and the water tank 30. Of course, it is preferred that if the rear surface 22' of the dispenser housing 22 is shaped in a plane surface, the front surface 30' of the water tank 30 be also shaped in a plane surface and the predetermined gap is formed therebetween.

The water tank 30, which is installed in the insulating layer 18 between the outer door 15 and the door liner 16, should be maintained at a fully low temperature by cold air in the storage space 12 and not be frozen over. In order to keep the water in the water tank 30 at a constant temperature, the insulating layer 18 with a predetermined thickness should be provided between the water tank 30 and the storage space 12. In the present invention, there is a predetermined gap between a plane portion of a rear surface of the water tank 30 and the door liner 16. Therefore, it is possible to obtain the uniform heat transfer between the storage space 12 and the water tank 30.

A heater 40 is installed between the dispenser housing 22 and the water tank 30. The heater 40 is preferably installed on the rear surface 22' of the dispenser housing 22. Since the heater 40 is installed on the rear surface 22' of the dispenser housing 22, it is also possible to keep a uniform gap between the heater 40 and the front surface 30' of the water tank 30. Therefore, heat generated from the heater 40 is generally and uniformly transferred to the water tank 20.

The heater 40 may serve to prevent freezing of the water in the water tank 30 and simultaneously frostiness on an external surface of the dispenser housing 22 due to a temperature difference.

In the meantime, in order to measure the temperature of the water in the water tank 30, the water tank 30 is mounted with a temperature sensor 50. It is preferred that the temperature sensor 50 is provided on the rear surface of the water tank 30. The temperature sensor 50 is connected to a controller 52 which is a central processing unit of the refrigerator, so that the temperature detected by the temperature sensor 50 may be displayed on a display 54 through the controller 52. In general, the display 54 is installed on the front surface of the refrigerator door and thus displays an operational state of the refrigerator to the users.

In addition, the controller 52 of the refrigerator is connected to an input portion 58, through which the users control the operation of refrigerator, in addition to the temperature sensor 50 and the display 54 as described above. The input portion 58, which is installed generally adjacent to the display 54, is a portion through which the users input signals for controlling operational modes of the refrigerator and the like. The controller 52 is also connected to a heater driver 56 for controlling the heater 40, and thus may operate the heater 40 by controlling the heater driver 56.

Hereinafter, the operation of the first embodiment according to the present invention so configured will be described.

In the present invention, the front surface 30' of the water tank 30 installed in the insulating layer 18 of the door 14 is spaced apart by a predetermined interval from the rear surface 22' of the dispenser housing 22, and simultaneously, the rear surface 22' of the dispenser housing 22 and the front surface 30' of the water tank 30 correspond to each other in shape, that is, the rear surface 22' of the dispenser housing 22 is shaped in a convexly curved surface and the front surface 30' of the water tank 30 is shaped in a concavely curved surface.

In addition, the rear surface of the water tank 30 is shaped in a plane surface corresponding to the door liner 16, the insulating layer 18 with a predetermined thickness is also provided between the door liner 16 and the rear surface of the water tank 30.

Thus, the water stored in the water tank 30 is not frozen over and may be maintained at a constant temperature even though the storage space 12 is a freezing chamber. It is the reason why the insulating layer 18 is provided between the door liner 16 and the water tank 30 and the heat may be provided from the heater 40.

That is, if it is necessary to provide the heat to the water tank 30 on the basis of the value detected in the temperature sensor 50, the controller 52 controls the heater driver 56 so that the heater 40 is caused to operate. When the heater 40 operates and generates the heat, the heat is transferred to the water tank 30 and prevents the freezing.

In the meantime, if the temperature detected by the temperature sensor 50 is equal to or more than a predetermined value, the temperature detected in the temperature sensor 50 is transferred to the controller 52, and then, the controller 52 controls the heater driver 56 to turn off the heater 40. Therefore, it is possible to always keep the temperature of the water in the water tank 30 constant.

Here, since the heater 40 and the water tank 30 are configured so that the gap therebetween is uniform, the heat generated from the heater 40 is uniformly transferred to the water tank 30 and thus the general temperature of the water in the water tank 30 can be kept uniform. The configuration that the insulating layer 18 having a generally uniform thickness is formed between the water tank 30 and the door liner 16 is also one of the reasons why the temperature of the water in the water tank 30 can be kept generally uniform.

Furthermore, since the water tank 30 is designed in shape so that it is generally and uniformly spaced apart from the door liner 16 and the dispenser housing 22, it is possible for foam liquid to smoothly flow when the door 14 is manufactured. That is, while the water tank 30 is supported in the door 14, the foam liquid is injected between the outer door 15 and the door liner 16 in order to form the insulating layer 18. At this time, since the foam liquid should be generally and uniformly filled in the door 14, fluidity of the foam liquid is important.

If the certain gaps are provided in front and the rear of the water tank 30 as in the present invention, it is possible to fully secure the fluidity of foam liquid. Therefore, in the present invention, the insulating layer 18 in the door 14 can be relatively securely formed.

[Mode for Invention]

Figure 6:
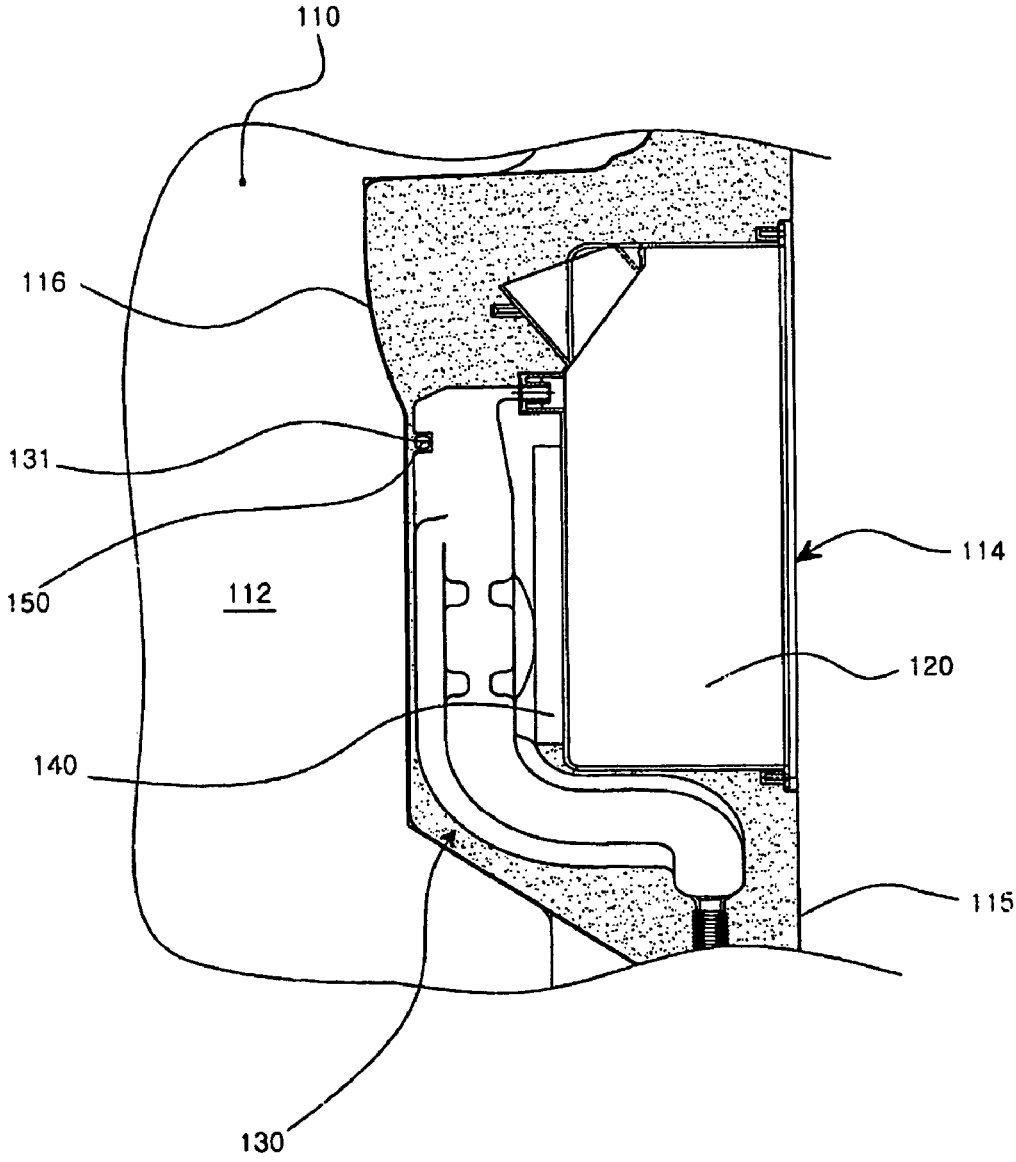
FIG. 6 is a schematic transverse section view showing a major portion of a second embodiment according to the present invention.
Figure 7:
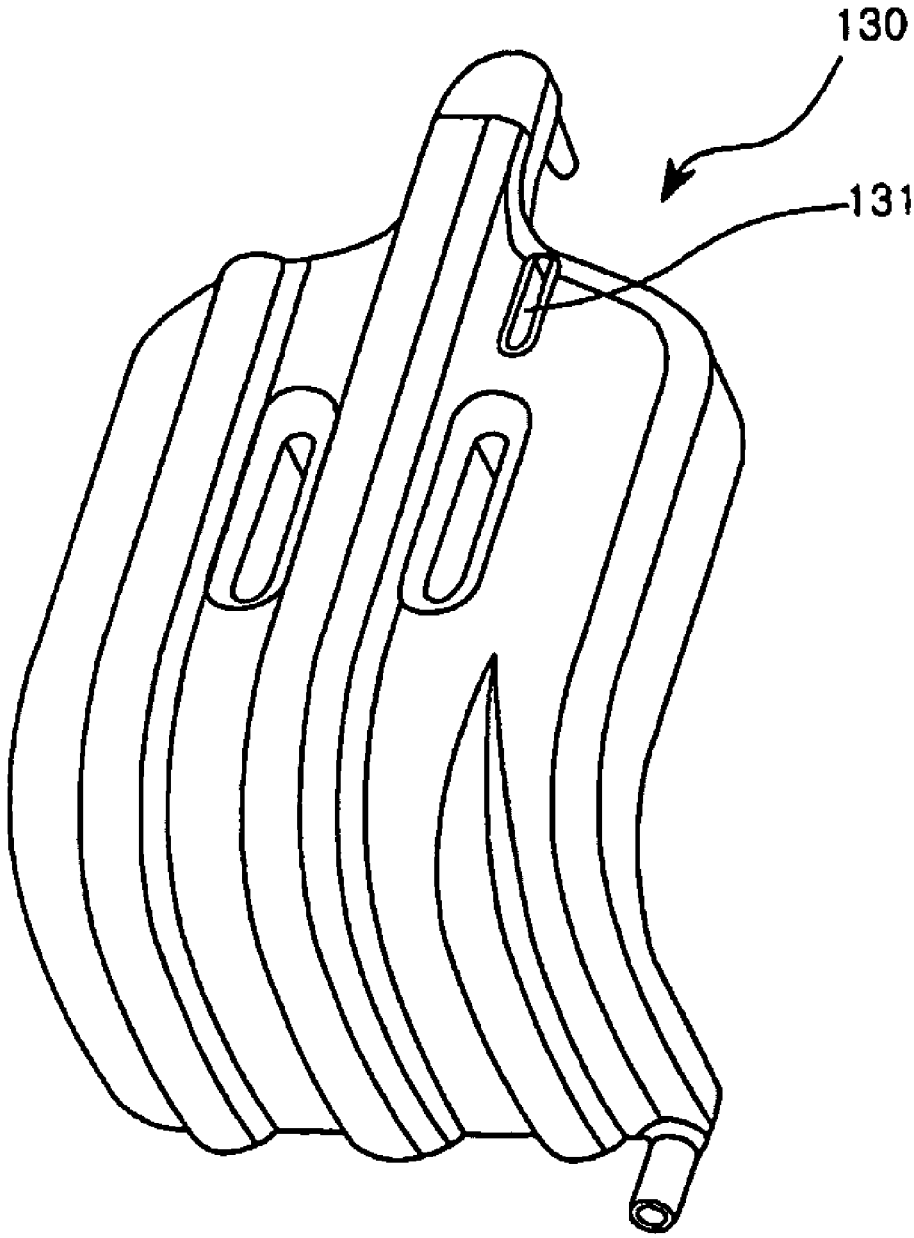
FIG. 7 is a perspective view showing a water tank of the second embodiment according to the present invention.
Figure 8:
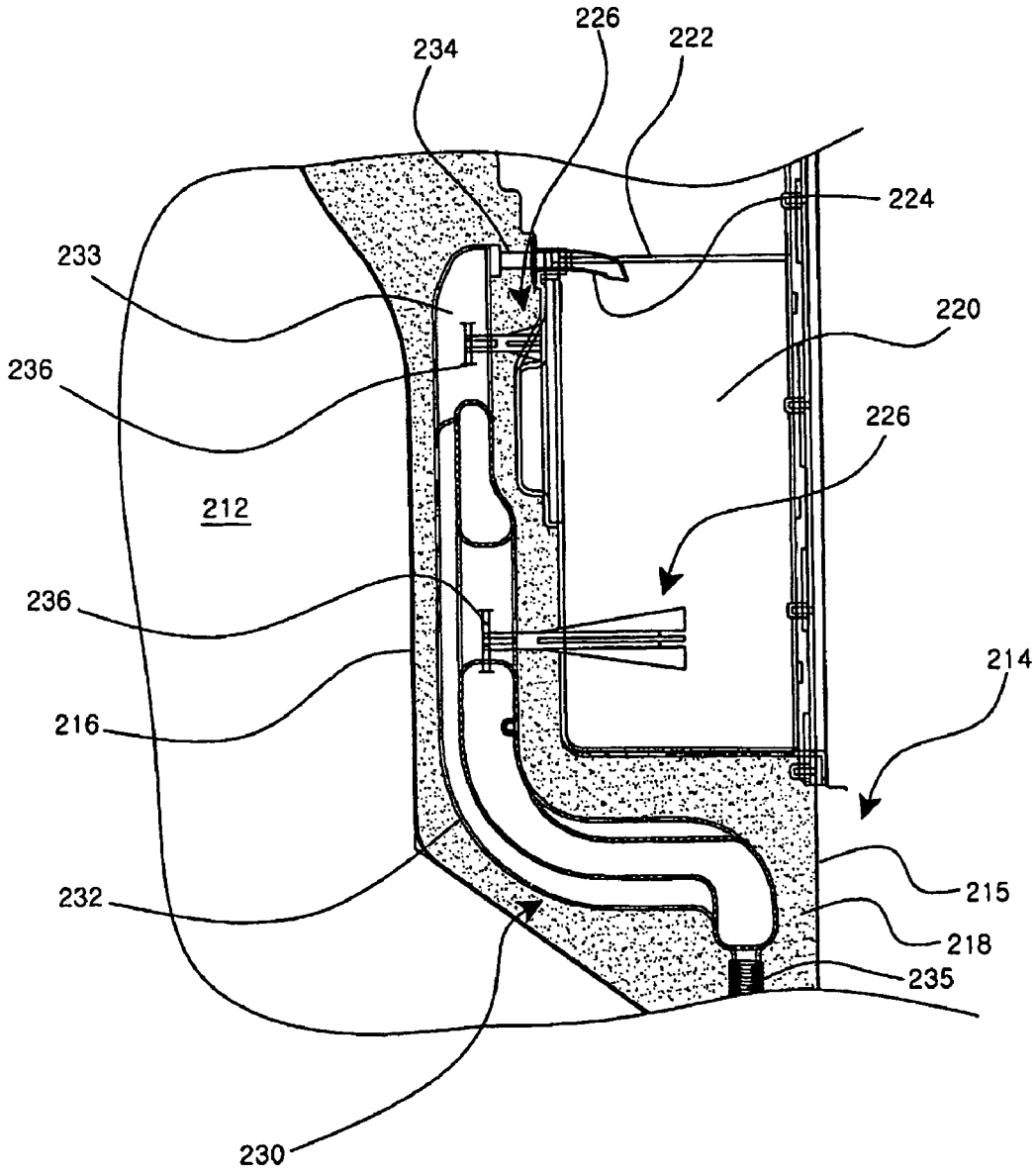
FIG. 8 is a schematic longitudinal section view showing a third embodiment according to the present invention.
Figure 9:
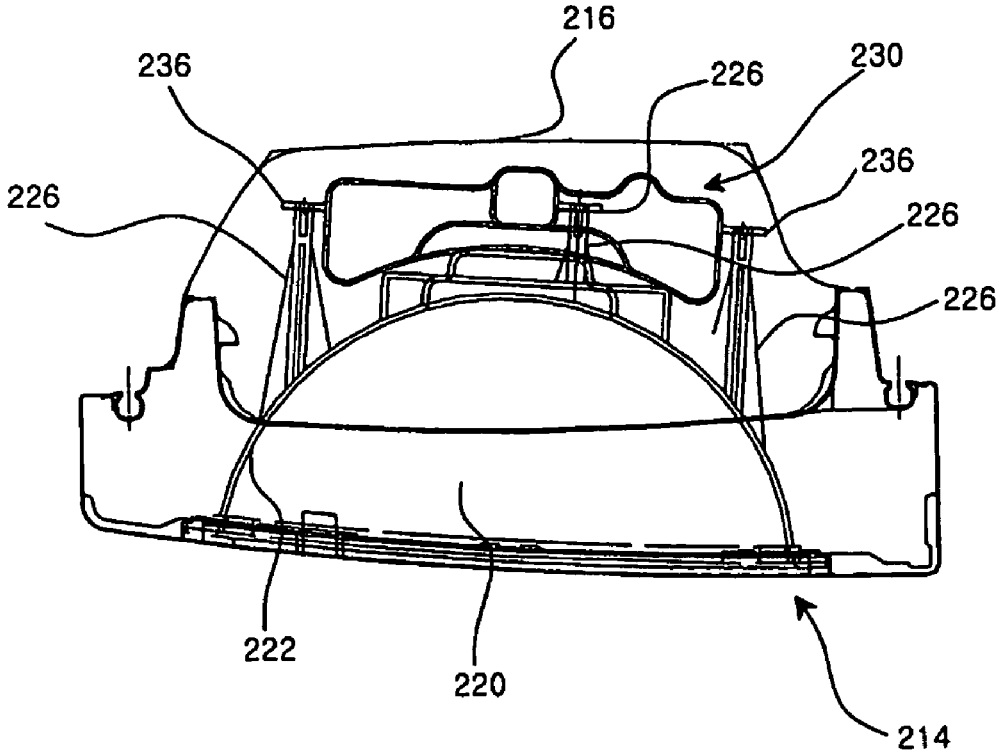
FIG. 9 is a schematic transverse section view showing the third embodiment according to the present invention.

Next, referring to FIGS. 6 and 7, a second embodiment of the present invention will be described. In the present embodiment, reference numerals increased by one hundred are given to the same elements as first previous embodiment, and only major portions will be described for convenience of description.

According to the figures, a sensor groove 131 is formed in a surface of a water tank 130. The sensor groove 131 is concavely formed in the surface of the water tank 130. A temperature sensor 150 is seated in the sensor groove 131. Here, a portion, in which the sensor groove 131 is formed, faces the storage space 112 when the water tank 130 is installed in a door 114.

Thus, the configuration that the sensor groove 131 is formed at the position facing the storage space 112 and then is mounted with the temperature sensor 150, is for the purpose of previously preventing the temperature sensor 150 from being under the influence from the outside. The configuration that the temperature sensor 150 is installed in the sensor groove 131 concavely formed in the surface of the water tank 130 is for the purpose of precisely detecting the temperature of the water in the water tank 130.

The temperature sensor 150 is connected to a controller which is a central processing unit of the refrigerator, so that the temperature detected in the temperature sensor 150 may be displayed on a display through the controller.

Now, referring to FIGS. 8 to 12, a third embodiment of the present invention will be described. According to the figures, a storage space 212 is formed in a refrigerator main body 210 and selectively opened and closed by a door 214. An external appearance of the door 214 is defined by an outer door 215 and a door liner 216. In order to insulate the heat transfer through the door 214, an insulating layer 218 is formed in a space between the outer door 215 and the door liner 216. A dispenser 220 is installed so that a front surface of the door 214 is exposed. It is preferred that the door 214 in which the dispenser 220 is installed be a freezing chamber door in a case where the refrigerator to which the present invention is applied is a side by side refrigerator.

The dispenser 220 is provided with a dispenser housing 222. The dispenser housing 222 is shaped as a concave portion recessed into the outer door 215. In general, the dispenser housing 222 is shaped as a half cylinder. At an upper portion of a concave space in the dispenser housing 222, a front end of a drainpipe 224 for discharging water to the outside is exposed. Support ribs 226 are formed at several positions on a rear surface of the dispenser housing 222 to extend. The lengths of support ribs 226 differ from each other according to the formation positions.

A water tank 230 is installed between the dispenser housing 222 and the door liner 216. The water tank 230 holds the water delivered from an external water supply source and then supplies the water to the dispenser 220. The water tank 230 is provided in the insulating layer 218.

The water tank 230 mainly comprises a tank main body 232, a neck 233 and a nozzle 234. A space for storing water is formed in the tank main body 232. A cross-sectional area, which the water flows through or is stored in, and which is shown when an interior of the tank main body 232 is transversely cut, is formed to be relatively larger than that of the neck 233. A space which the water is stored in or flows through is formed in the neck 233, which is formed at an upper end of the tank main body 232, so that the nozzle 234 and the tank main body 232 communicate with each other.

Figure 11:
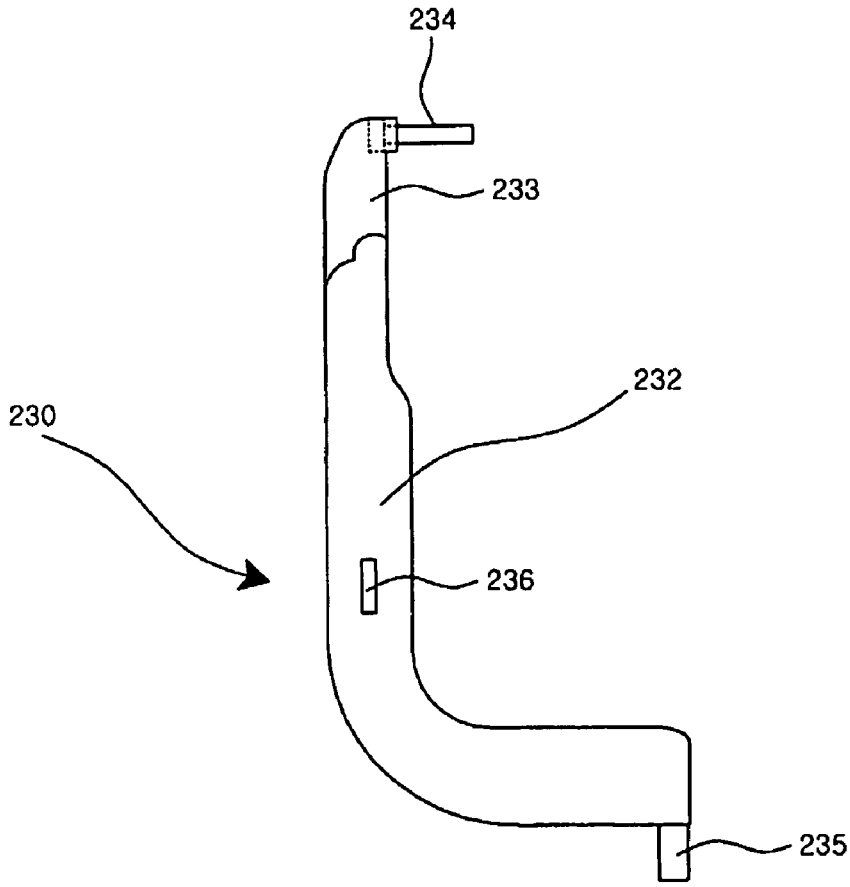
FIG. 11 is a side view showing the water tank of the third embodiment according to the present invention.
Figure 12:
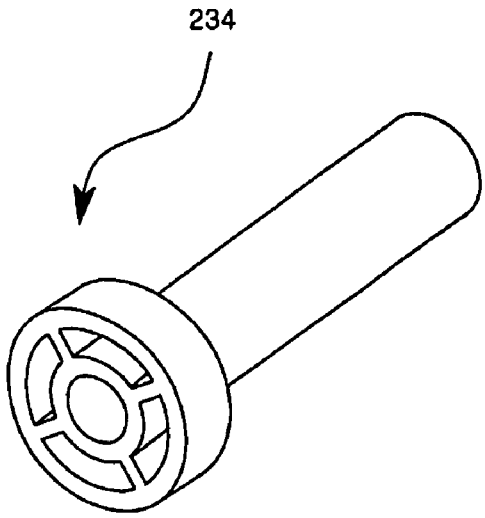
FIG. 12 is a perspective view showing a nozzle of the third embodiment according to the present invention.

As shown in FIGS. 11 and 12, the nozzle 234 is relatively long and is formed with a narrow internal channel. The channel of the nozzle 234 is formed to be much narrower than a flow sectional area of the tank main body 232 or the neck 233. The channel in the nozzle 234 is formed to be narrow as above because the water tank 230 is installed in the door 212. That is, it is the reason why the water stored in the water tank 230 rolls and fluctuates when the door 212 is opened and then can be discharged through the nozzle 234.

However, if the flow sectional area of the nozzle 234 is formed to be relatively much narrower than that of the tank main body 232 or the neck 233, the water flows only in the tank main body 232 or the neck 233 and is not discharged through the nozzle 234 even when the water fluctuates.

If the nozzle 234 so configured is formed along with the tank main body 232 and the neck 233 when they are formed by blow molding, there is concern about the decrease in its precision. In such a case, there is concern about water leakage when the nozzle 234 is engaged with the drainpipe 224.

Therefore, in the present invention, the nozzle 234 is additionally manufactured by injection molding. In general, the injection molding can cause the size to be precise. After the nozzle 234 is formed by the injection molding and inserted into a mold for the blow molding, the tank main body 232 and the neck 233 are formed. With such a manner, the nozzle 234 may be integral with the neck 233.

A side of a lower end of the tank main body 232 is provided with an injection port 235. The injection port 235, through which the interior and exterior of the tank main body 232 communicate with each other, is connected to an external water supply source through a supply pipe (not shown).

A plurality of fastening ribs 236 are formed on an outer surface of the water tank 230. The fastening ribs 236 are formed at positions corresponding to the support ribs 226. In the present embodiment, the fastening ribs 236 are formed at both sides of the tank main body 232 and a side of the neck 233. The fastening ribs 236 are fastened to the support ribs 226 by fasteners such as screws. Of course, the fastening ribs 236 and the support ribs 226 may be matched in shape and fastened to each other.

Figure 10:
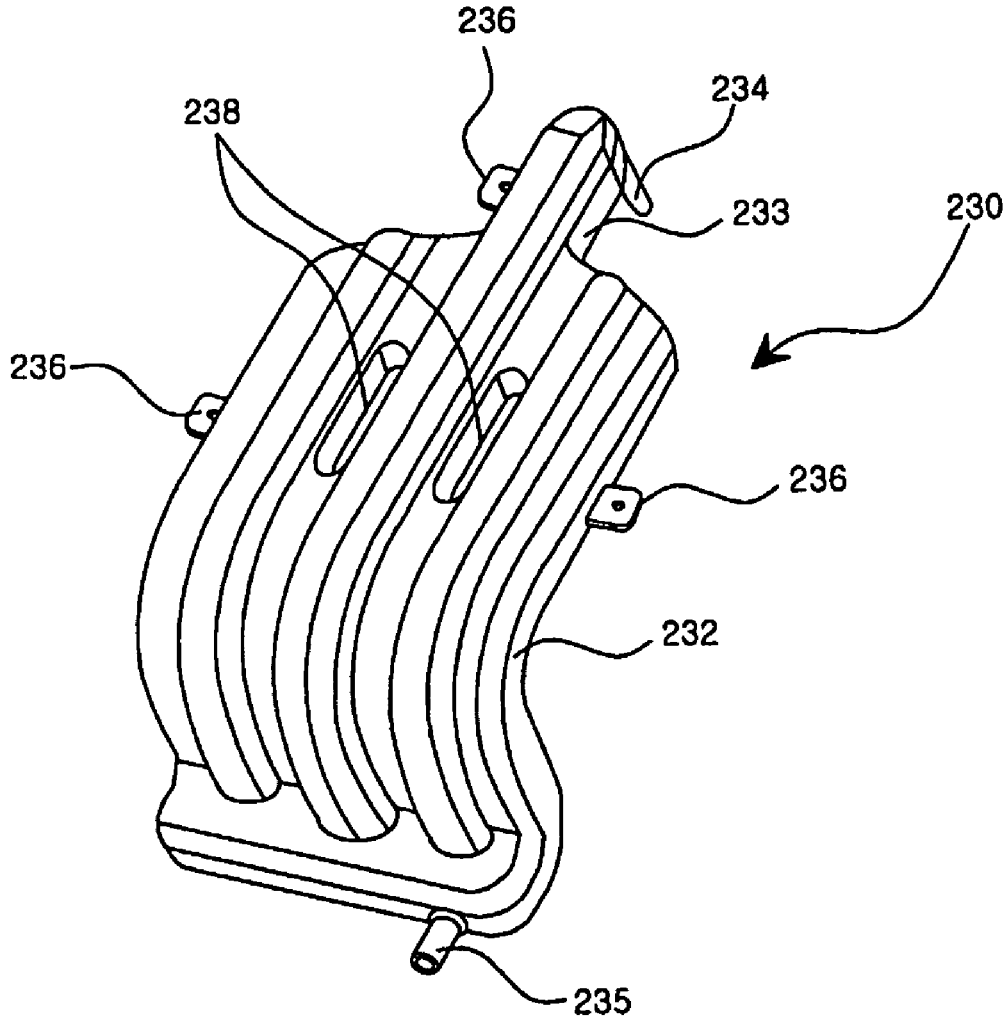
FIG. 10 is a perspective view showing a water tank of the third embodiment according to the present invention.

In the meantime, the tank main body 232 of the water tank 230 is formed with through-holes 238. The through-holes 238 serve to cause the foam liquid to flow smoothly when the foam layer 218 is formed. As shown in FIG. 10, the water tank 230 is formed so that it is flat and its lower portion is curved along the rear surface of the dispenser housing 222. Therefore, the foam liquid may not smoothly flow especially between the dispenser housing 222 and the water tank 230. In order to prevent such a phenomenon, by forming the through-holes 238, the foam liquid smoothly flows from the rear surface to the front surface of the water tank 230, that is, to a space between the water tank 230 and the rear surface of the dispenser housing 222.

It is preferred that a plurality of the through-holes 238 be formed in an intermediate portion of the tank main body 232, particularly, in a relatively thinner portion in the tank main body 232.

In the present invention, the water tank 230 is shaped corresponding to the rear surface of the dispenser housing 222, and the tank main body 232 which extends up to a lower portion of the dispenser housing 222 is formed to be bent so that it is spaced apart from the lower portion of the dispenser housing 222 by a substantially uniform distance.

It is for the purpose of causing the storage space 212 of the refrigerator main body 210 not to be narrow by allowing the thickness of the door 214 not to relatively increase since the water tank 230 is installed in the insulating layer 218 formed in the door 214.

Of course, the shape of the water tank 230 is not limited to that shown in the present embodiment. For example, the water supply tank 230 may be vent and formed to conform to upper, rear and lower, rear and both side surfaces of the dispenser housing 222, thus being formed in a "ㄷ" shape. Further, the water tank 230 may be vent and formed to conform to the rear and upper surfaces of the dispenser housing 222 in order to be formed in a "ㄱ" shape.

Hereinafter, the operation of the third embodiment according to the present invention so configured will be described in detail.

To install the water tank 230 in the door 214 in the present embodiment will be described. The dispenser 220 is installed to be exposed toward a front surface of the outer door 215 of the door 214. A plurality of the support ribs 226, to which the fastening ribs 236 of the water tank 230 are engaged, are provided on the rear surface of the dispenser housing 222 of the dispenser 220.

In such a state, the water tank 230 is fastened to the dispenser housing 222. Of course, the nozzle 234 is engaged with the drainpipe 224, and an additional supply pipe is connected to the injection port 235. Since contrary to the tank main body 232, the nozzle 234 engaged with the drainpipe 224 is injection-molded and thus has high precision, the leakage between the nozzle 234 and the drainpipe 224 does not occur. Then, the foam liquid is applied to the rear surface of the outer door 215.

The foam liquid is applied to the rear surface of the outer door 215 and a variety of parts installed therein. Then, the dispenser 220, the water tank 230, the rear surface of the outer door 215 and the like, to which the foam liquid is applied, are sheltered by engaging the door liner 216 to the outer door 215. In such a state, the foam liquid is filled between the outer door 215 and the door liner 216.

At this time, since the water tank 230 is set in place by fastening the fastening ribs 236 to the support ribs 226, the position of the water tank 230 is not distorted or deformed by the foam pressure of the foam liquid. Thus, the water tank 230 is installed at a more precise position.

In addition, the through-holes 238 formed in the tank main body 232 of the water tank 230 cause the foam liquid to more smoothly flow around the water tank 230. That is, the insulating layer 218 is allowed to be more smoothly formed around the water tank 230 by smoothly delivering the foam liquid around the front and rear surfaces of the tank main body 232. Therefore, the water tank 230 is more securely fixed and insulated.

If the foam liquid is filled between the door liner 216 and the outer door 215 of the door 230 and dried, the insulating layer 218 is formed. The insulating layer 218 minimizes the heat transfer between the storage space 212 in the refrigerator main body 210 and its outside through the door 214.

In the meantime, while the water tank 230 is installed between the door liner 216 and the dispenser housing 222, a portion of the water tank 230 that extends beyond the lower portion of the dispenser housing 222 is formed to cover the lower surface of the dispenser housing 222. Thus, the portion of the water tank 230 that extends up to the lower portion of the dispenser 220 causes the thickness or volume of the door 230 not to increase. Accordingly, the volume of the storage space 212 can be formed relatively large.

Figure 13:
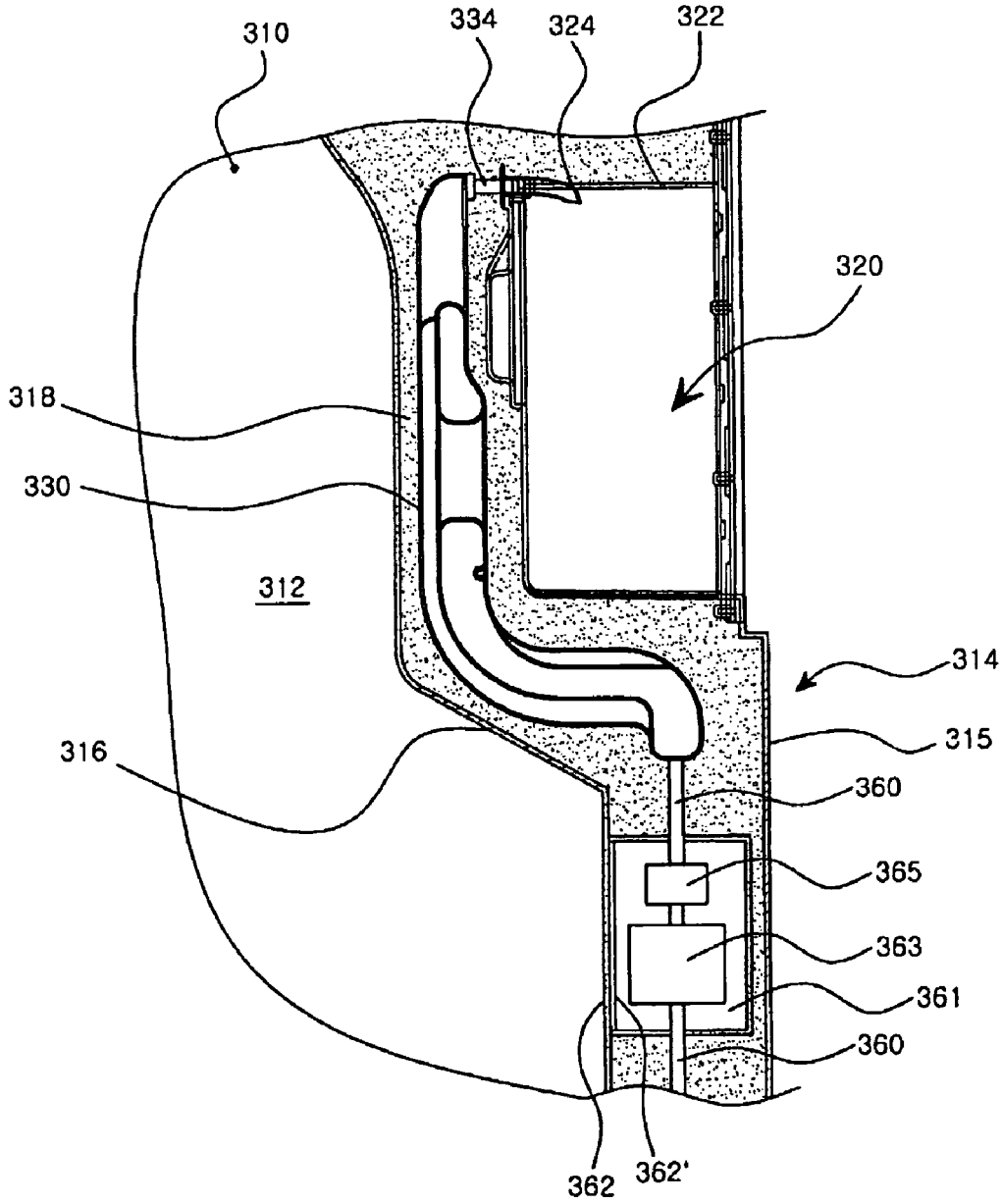
FIG. 13 is a schematic longitudinal section view showing a fourth embodiment according to the present invention.

FIG. 13 shows a fourth embodiment of the present invention. According to the figure, a storage space 312 is formed in a refrigerator main body 310 and selectively opened and closed by a door 314. An external appearance of the door 314 is defined by an outer door 315 and a door liner 316. In order to insulate the heat transfer through the door 314, an insulating layer 318 is formed in a space between the outer door 315 and the door liner 316. A dispenser 320 is installed so that a front surface of the door 314 is exposed. It is preferred that the door 314 in which the dispenser 320 is installed be a freezing chamber door in a case where the refrigerator to which the present invention is applied is a side by side refrigerator.

The dispenser 320 is provided with a dispenser housing 322. The dispenser housing 322 is shaped as a concave portion recessed into the outer door 315. In general, the dispenser housing 322 is shaped in a half cylinder. At an upper portion of a concave space in the dispenser housing 322, a front end of a drainpipe 324 for discharging water to the outside is exposed.

A water tank 330 is installed between the dispenser housing 322 and the door liner 316. The water tank 330 holds the water delivered from an external water supply source and then supplies the water to the dispenser 320. The water tank 330 is provided in the insulating layer 318. Reference numeral 334 designates a nozzle of the water tank 330, which is a portion connected to the drainpipe 324. The water tank 330, in which a variety of features described in the third embodiment are combined and provided, may be used.

A supply pipe 360, which is connected to the interior of the door 314, is connected to the water tank 330. The supply pipe 360 is also connected to the external water supply source such that it generally extends from the refrigerator main body 310 to the interior of the door 314 through a hinge assembly through which the door 314 is pivotably installed to the refrigerator main body 310.

A valve chamber 361 is formed in the door 314 so that the supply pipe 360 passes through the interior of the valve chamber 361. The valve chamber 361 is formed in the insulating layer 318 so as to be opened toward a rear surface of the door 314. The valve chamber 361 is sheltered by a chamber cover 362. The chamber cover 362 shelters between the storage space 312 and a valve chamber 362, so that cold air in the storage space 312 is interrupted from being delivered to the valve chamber 362. To this end, the chamber cover 362 is made of a material itself of a superior insulating ability, or preferably, an additional insulating layer 362' is provided on at least a surface of the chamber cover 362 as shown in the figure.

A filter 363 and a valve 365 are installed in the valve chamber 361. The filter 363 serves to filter off a variety of impurities contained in the water delivered from the external water supply source. The valve 365 transfers the water filtered in the filter 363 to the water tank 330. For reference, the valve 365 may also be configured so as to supply the water to an ice maker. In such a case, the ice maker should be installed at the side of the door 314.

The operation of the fourth embodiment so configured will be briefly described.

If it is necessary to supply the water tank 330 or the ice maker with the water, the valve 365 is selectively opened. When the valve 365 is selectively opened, the water is delivered from the external water supply source to the filter 363 through the supply pipe 360. The water delivered to the filter 363 is purified and then selectively delivered to the water tank 330 or the ice maker by controlling the valve 365.

The users may use both the water delivered to the water tank 330 and the ice made of the water delivered to the ice maker by taking out the water and ice through the dispenser 320 by a predetermined amount.

In the meantime, since the filter 363 is an expendable part, it should be periodically exchanged. To this end, the users open the chamber cover 362 and then exchange the filter 363. In addition, maintenance of the valve 365 can also be performed after opening the chamber cover 362. That is, in the present embodiment, the exchange of the filter 363 and the maintenance of the valve 365 may be performed simply after opening the door 314.

Figure 14:
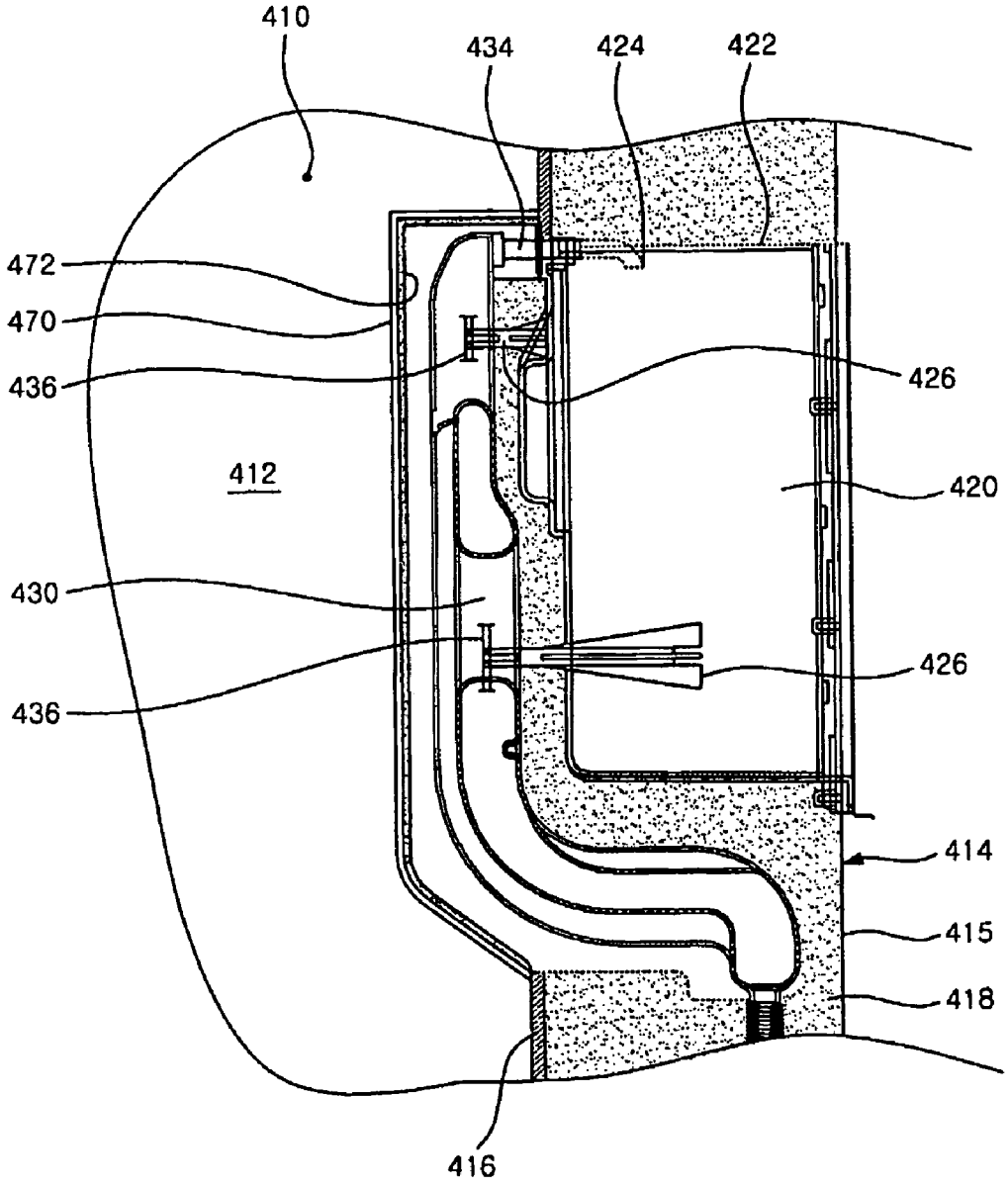
FIG. 14 is a schematic longitudinal section view showing a fifth embodiment according to the present invention.
Figure 15:
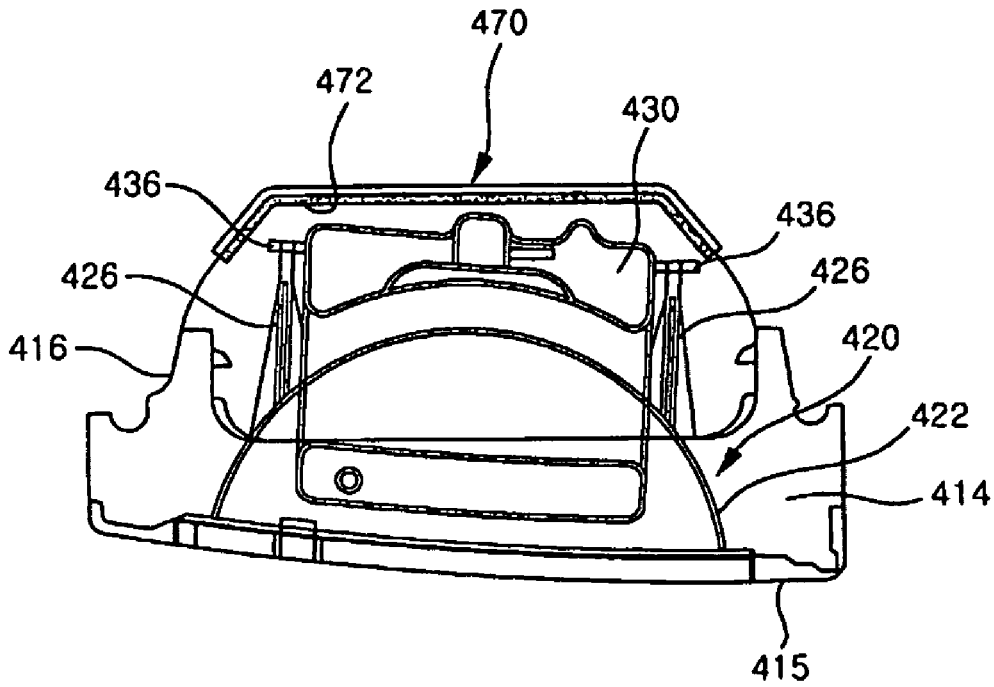
FIG. 15 is a schematic transverse section view showing the fifth embodiment according to the present invention.

Next, referring to FIGS. 14 and 15, a fifth embodiment of the present invention will be described. According to the figures, a storage space 412 is formed in a refrigerator main body 410 and selectively opened and closed by a door 414. An external appearance of the door 414 is defined by an outer door 415 and a door liner 416. In order to insulate the heat transfer through the door 414, an insulating layer 418 is formed in a space between the outer door 415 and the door liner 416. A dispenser 420 is installed so that a front surface of the door 414 is exposed. It is preferred that the door 414 in which the dispenser 420 is installed be a freezing chamber door in a case where the refrigerator to which the present invention is applied is a side by side refrigerator.

The dispenser 420 is provided with a dispenser housing 422. The dispenser housing 422 is shaped as a concave portion recessed into the outer door 415. In general, the dispenser housing 422 is shaped in a half cylinder. At an upper portion of a concave space in the dispenser housing 422, a front end of a drainpipe 424 for discharging water to the outside is exposed. Support ribs 426 are formed at several positions on a rear surface of the dispenser housing 422 to extend. The lengths of support ribs 426 differ from each other according to the formation positions.

A water tank 430 is installed between the dispenser housing 422 and the door liner 416. The water tank 430 holds the water delivered from an external water supply source and then supplies the water to the dispenser 420. The water tank 430 is provided at a position adjacent to a rear surface of the door 414 and not installed in the insulating layer 418. It is for the purpose of enabling to exchange the water tank 430. That is, after a rear portion of the dispenser 420 is formed with a space for installing the water tank 430, the water tank 430 is installed therein. Then, the insulating layer 418 is formed by injecting foam liquid into an interior of the door 414 corresponding to a front of a portion in which the water tank 430 is installed. At this time, the insulating layer 418 should be designed so that the mounting and dismounting of the water tank 430 is not hindered. Reference numeral 434 designates a nozzle connected to the drainpipe 424.

A plurality of fastening ribs 436 are formed on an outer surface of the water tank 430. The fastening ribs 436 are formed at positions corresponding to the support ribs 426. The fastening ribs 436 are fastened to the support ribs 426 by fasteners such as screws. Of course, the fastening ribs 436 and the support ribs 426 may be matched in shape and fastened to each other.

A rear surface of the water tank 430, i.e., a surface facing the storage space 412 is sheltered by a cover 470. The cover 470 is manufactured of a material itself of a superior insulating ability, or an additional cover insulating layer 472 is provided on an inner surface of the cover 470. It is for the purpose of causing the cold air in the storage space 412 not to influence the water tank 430.

The cover 470 should be detachably installed to the door liner 416 of the door 414. The cover 470 may be fastened to the door liner 416, for example, by forming engaging hooks and engaging grooves at corresponding positions of the cover 470 and the door liner 416, respectively, or by using screws. Of course, the cover 470 may be configured to be opened even though the whole of the cover 470 is not detached.

For reference, the cover 470 is configured so as to open and close in the present specification, which means that since the cover 470 is detachably installed to the door liner 416 as described above, the maintenance of the water tank 430 can be made.

In the fifth embodiment of the present invention so configured, it is possible to separate the water tank 430 from the door 414 and to mend and repair it. That is, the water tank 430 is separated from the door 414 by opening the cover 470, exposing the water tank 430 and releasing the engagement state of the support ribs 426 and the fastening ribs 436.

After the water tank 430 is separated from the door 414, the water tank 430 may be cleaned and mounted in the door 414 again, or the used water tank 430 may be dumped and exchanged for new one of the water tank 430. That is, the fastening ribs 436 of the water tank 430 are engaged and fixed to the support ribs 426. Of course, the water tank 430 should be connected to a supply pipe, and the nozzle 434 and the drainpipe 424 of the dispenser 420 should be connected to each other.

After the water tank 430 is newly mounted in the door 414 as above, by closing the cover 470, the cold air in the storage space 412 is not caused to influence the water tank 430.

Figure 16:
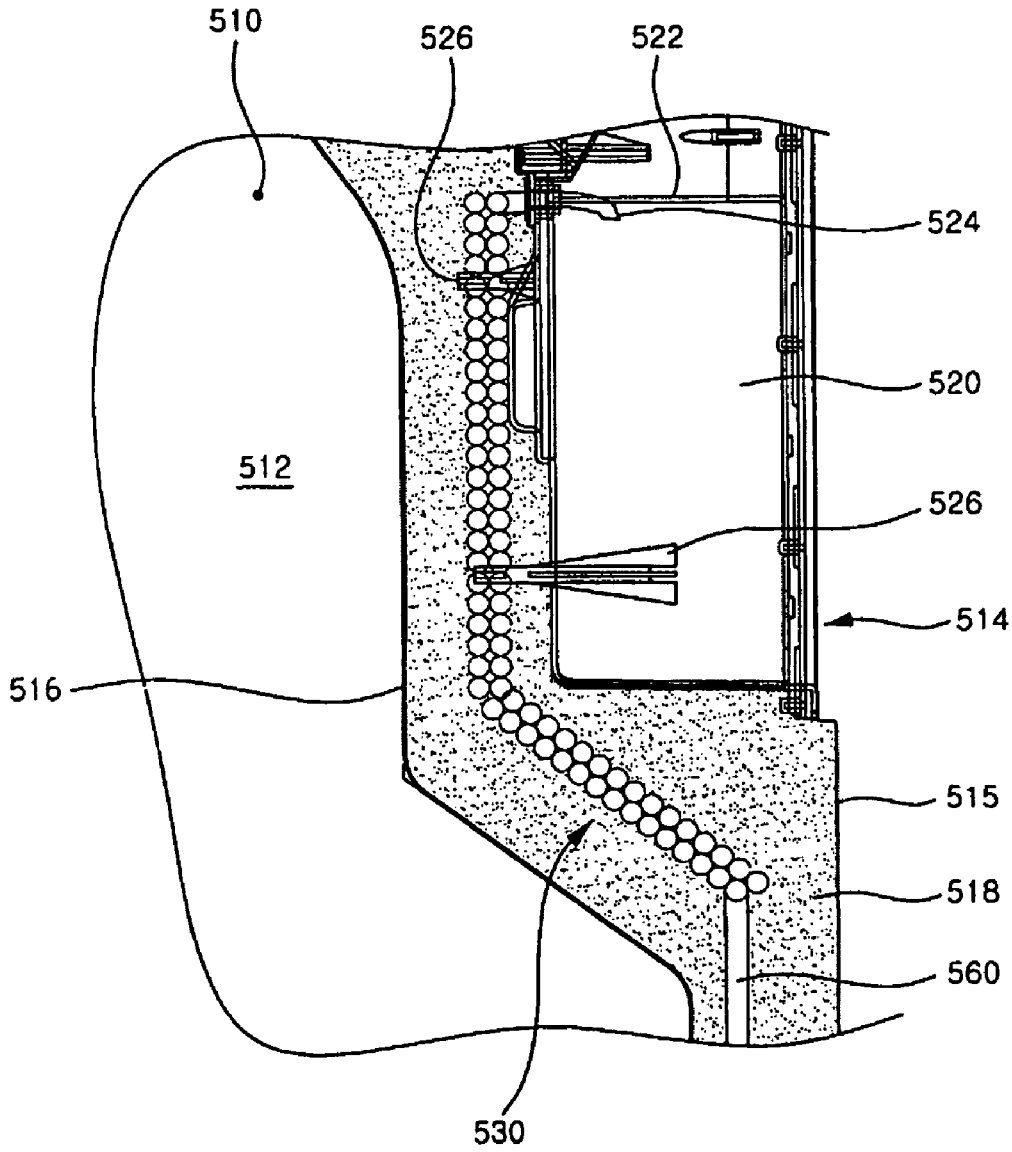
FIG. 16 is a schematic longitudinal section view showing a sixth embodiment according to the present invention.

Next, referring to FIG. 16, a sixth embodiment of the present invention will be described. According to the figure, a storage space 512 is formed in a refrigerator main body 510 and selectively opened and closed by a door 514. An external appearance of the door 514 is defined by an outer door 515 and a door liner 516. In order to insulate the heat transfer through the door 514, an insulating layer 518 is formed in a space between the outer door 515 and the door liner 516. A dispenser 520 is installed so that a front surface of the door 514 is exposed. It is preferred that the door 514 in which the dispenser 520 is installed be a freezing chamber door in a case where the refrigerator to which the present invention is applied is a side by side refrigerator.

The dispenser 520 is provided with a dispenser housing 522. The dispenser housing 522 is shaped as a concave portion recessed into the outer door 515. In general, the dispenser housing 522 is shaped in a half cylinder. At an upper portion of a concave space in the dispenser housing 522, a front end of a drainpipe 524 for discharging water to the outside is exposed. Support ribs 526 are formed at several positions on a rear surface of the dispenser housing 522 to extend. The lengths of support ribs 526 differ from each other according to the formation positions.

A reservoir 530 is provided between the dispenser housing 522 and the door liner 516. The reservoir 530 is formed by bending a tube of synthetic resin or metal many times. The reservoir 530 is formed in two layers, as shown in the figure of the present embodiment as a sectional view. Of course, the tube constituting the reservoir 530 may be formed in two or more layers. The number of layers of the tube constituting the reservoir 530 is determined by taking the thickness of the door 514 and the like into consideration.

An end of the reservoir 530 is connected to a supply pipe 560 which supplies the water delivered from an external water supply source. The other end of the reservoir 530 is connected to the drainpipe 524 of the dispenser 520. The supply pipe 560 itself may be used as the tube constituting the reservoir 530 by extending the supply pipe 560. That is, the reservoir 530 may be formed by bending the supply pipe 560. Of course, the tube constituting the reservoir 530 may be configured and formed in addition to the supply pipe 560.

In addition, the reservoir 530, which is installed in the insulating layer 518, may be fixed to support ribs 526 which extend from the rear surface of the dispenser housing 522 in order to prevent the position of the reservoir 530 from being distorted in the process of forming the insulating layer 518. That is, in a state where the reservoir 530 which is formed by bending the tube is fixed to the support ribs 526, the insulating layer 518 is formed. Of course, the reservoir 530 is not necessarily fixed to the dispenser housing 522.

In the meantime, the reservoir 530 may be variously modified according to the arrangement of the tube. It is preferred that the tube constituting the reservoir 530 be arranged within the extent that the flow of the foam liquid is not obstructed. For example, although the tube is arranged in a zigzag from side to side as the reservoir 530 views the door 514 from the rear in the figure, the tube may be arranged in a zigzag upward and downward.

In the sixth embodiment of the present invention so configured, the water supplied from the external water supply source through the supply pipe 560 is held in the tube constituting the reservoir 530 and then discharged through the drainpipe 524 of the dispenser 520.

That is, the reservoir 530 is formed by bending a tube in a zigzag shape without using an additional water tank, and the water in the reservoir 530 is maintained at a predetermined temperature due to the cold air in the storage space and then discharged through the dispenser 520.

In the present embodiment, since the reservoir 530 is formed by bending the tube in a zigzag shape, the water in the reservoir 530 is discharged in sequence. That is, the water first introduced into the reservoir 530 is first discharged to the dispenser 520. Therefore, sediments do not remain in the tube constituting the reservoir 530, and are easily discharged due to the water flow even when sediments are produced.

Figure 17:
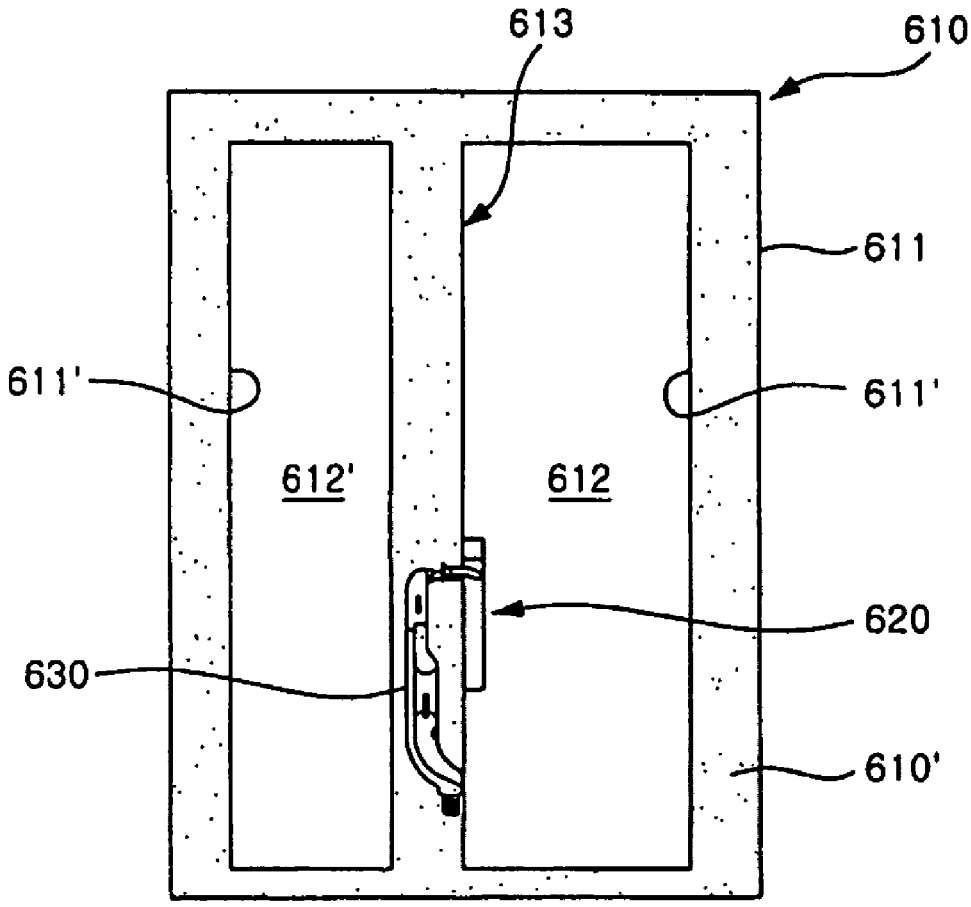
FIG. 17 is a schematic longitudinal section view showing a seventh embodiment according to the present invention.

Next, referring to FIG. 17, a seventh embodiment of the present invention will be described. According to the figure, external and internal surfaces of a refrigerator main body 610 are defined by outer and inner cases 611 and 611', respectively. An insulating layer 610' is formed between the outer and inner cases 611 and 611'. The insulating layer 610' serves to insulate the heat transfer between the interior and exterior of the refrigerator main body 610.

Refrigerating and freezing chambers 612 and 612' which are storage spaces are formed in the refrigerator main body 610. The refrigerating and freezing chambers 612 and 612' are divided by a barrier 613. The barrier 613 is made by forming the insulating layer 610' between the inner cases 611'.

In the meantime, in the present embodiment, a dispenser 620 is provided on a side wall of the barrier 613 corresponding to an inner wall surface of the refrigerating chamber 612. The dispenser 620, through which users take out and drink water, generally provides water to the outside of the door. However, since the dispenser 620 is installed in the refrigerator main body 610 in the present embodiment, water can be provided after the door is opened.

A water tank 630 for storing the water supplied to the dispenser 620 is provided in the insulating layer 610' in the barrier 613. However, the water tank 630 is not necessarily installed in the insulating layer 610' in the barrier 613. For example, the water tank 630 may be installed at any position in the insulating layer 610' formed between the outer and inner cases 611 and 611'.

However, when the water tank 630 is installed in the insulating layer 610', it is more preferred that the water tank 630 be installed at a position where the temperature of the water therein can be maintained at a constant value. That is, the water tank 630 should be installed at a position where the water is maintained at a constant temperature (that is, a temperature of which the water is not frozen over and refreshes users upon drinking it) under the influence of the low temperature in the refrigerating chamber 612 or the freezing chamber 612'.

Then, it is preferred that the dispenser 620 and the water tank 630 be installed at positions adjacent to each other. That is, it is preferred that the water tank 630 be installed at a position where a drainpipe of the dispenser 620 and the water tank 630 are directly connected to each other without using an additional connecting pipe.

Figure 18:
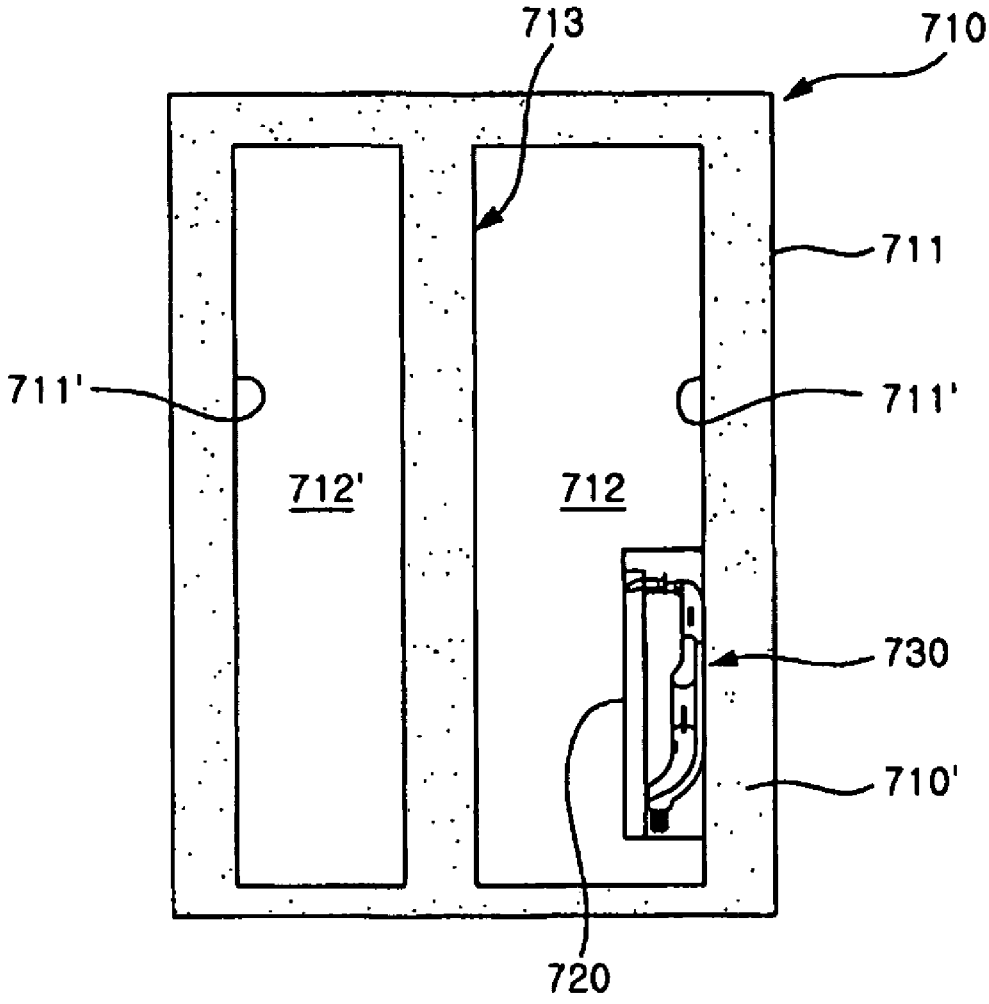
FIG. 18 is a schematic longitudinal section view showing an eighth embodiment according to the present invention.

In the meantime, FIG. 18 shows an eighth embodiment of the present invention. Herein, reference numerals expressed in seven hundreds are given to the elements corresponding to those of the seventh embodiment of FIG. 17. Here, a water tank 730 is installed on a surface of an inner case 711' of a refrigerating chamber 712.

Then, a dispenser 720 is installed just in front of the water tank 730. For reference, the side surface of the refrigerating chamber 712, on which the water tank 730 and the dispenser 720 are installed, is one of portions where frequency of use is lowest. In such a present embodiment, the water discharged through the dispenser 720 is always kept in a low temperature state under the influence of the temperature in the refrigerating chamber 712.

INDUSTRIAL APPLICABILITY

Although a variety of the embodiments of the present invention are described with reference to the drawings in above, in addition to the aforementioned embodiments, other embodiments into which the configurations as described above are variously combined can be made.

For example, it is possible to consider the configuration that any ones of the through-holes 238 and the fastening ribs 236 are provided in the water tank 230 in the third embodiment. It is also possible to consider an embodiment in which the nozzle 235 is additionally formed by injection molding without the through-holes 238 and the fastening ribs 236 and the other portions of the water tank 230 are formed by blow molding. Furthermore, it is possible to consider an embodiment in which the water tank 230 of the third embodiment is substituted with the water tank 30 or 130 of the first or second embodiment.

In addition, although the filter 363 and the valve 365 are installed in the door 314 in the fourth embodiment, the filter may be installed in the door or the refrigerator main body in other embodiments.

The invention claimed is:

1. A refrigerator including a main body having a storage space formed therein, and a door having an insulating layer therein and rotatably coupled to the main body so as to selectively open and close the storage space, the refrigerator comprising:

a dispenser including a dispenser housing installed in a concave portion of a front surface of the door wherein the dispenser discharges water to an outside of the refrigerator;

a water tank installed between a door liner that de fines a rear surface of the door and the dispenser housing, wherein the water tank is spaced apart by a predetermined interval from each of the door liner and the dispenser housing and the water tank is at least partially surrounded by the insulating layer, and wherein the water tank stores water supplied from an external water supply source at a predetermined temperature and provides water to the dispenser for discharge to the outside; and a temperature sensor provided on an external surface of the water tank, wherein the temperature sensor detects a temperature of the water stored in the water tank, wherein the front surface of the door further comprises a display that displays a temperature of water stored in the water tank detected by the temperature sensor.

2. A refrigerator including a main body having a storage space formed therein, and a door having an insulating layer therein and rotatably coupled to the main body so as to selectively open and close the storage space, the refrigerator comprising:

a dispenser including a dispenser housing installed in a concave portion of a front surface of the door, wherein the dispenser discharges water to an outside of the refrigerator;

a water tank installed between a door liner that defines a rear surface of the door and the dispenser housing, wherein the water tank is spaced apart by a predetermined interval from each of the door liner and the dispenser housing and the water tank is at least partially surrounded by the insulating layer, and wherein the water tank stores water supplied from an external water supply source at a predetermined temperature and provides water to the dispenser for discharge to the outside; and a temperature sensor provided on an external surface of the water tank, wherein the temperature sensor detects a temperature of the water stored in the water tank, wherein the temperature sensor is seated in a sensor groove that is concavely formed in the external surface of the water tank.

3. The refrigerator as claimed in claim 2, wherein the sensor groove is formed at a position facing the storage space when the water tank is installed in the interior of the door.

4. A refrigerator including a main body having a storage space formed therein, and a door having an insulating layer therein and rotatably coupled to the main body so as to selectively open and close the storage space, the refrigerator comprising:

a dispenser including a dispenser housing installed in a concave portion of a front surface of the door, wherein the dispenser discharges water to an outside of the refrigerator;

a water tank installed between a door liner that defines a rear surface of the door and the dispenser housing, wherein the water tank is spaced apart by a predetermined interval from each of the door liner and the dispenser housing and the water tank is at least partially surrounded by the insulating layer, and wherein the water tank stores water supplied from an external water supply source at a predetermined temperature and provides water to the dispenser for discharge to the outside; and a support rib formed on and extending from a rear surface of the dispenser housing, wherein the water tank is fastened to the support rib and thus fixed to the interior of the door.

5. The refrigerator as claimed in claim 4, further comprising a fastening rib provided on the water tank, at a position corresponding to the support rib of the dispenser housing, wherein the water tank is fixed to the interior of the door by fastening the fastening rib to the support rib.

6. A refrigerator including a main body having a storage space formed therein, and a door having an insulating layer therein and rotatably coupled to the main body so as to selectively open and close the storage space, the refrigerator comprising:

a dispenser including a dispenser housing installed a concave portion of a front surface of the door, wherein the dispenser discharges water to an outside of the refrigerator; and a water tank installed between a door liner that defines a rear surface of the door and the dispenser housing, wherein the water tank is spaced apart by a predetermined interval from each of the door liner and the dispenser housing and the water tank is at least partially surrounded by the insulating layer, and wherein the water tank stores water supplied from an external water supply source at a predetermined temperature and provides water to the dispenser for discharge to the outside, wherein the water tank comprises a main body having a through-hole formed therein through which foam liquid that forms the insulating layer is injected.

7. The refrigerator as claimed in claim 6, wherein a plurality of the through-holes are bored through thinner portions of the main body.

8. A refrigerator including a main body having a storage space formed therein, and a door having an insulating layer therein and rotatably coupled to the main body so as to selectively open and close the storage space, the refrigerator comprising:

a dispenser including a dispenser housing installed in a concave portion of a front surface of the door, wherein the dispenser discharges water to an outside of the refrigerator; and a water tank installed between a door liner that defines a rear surface of the door and the dispenser housing, wherein the water tank is spaced apart by a predetermined interval from each of the door liner and the dispenser housing and the water tank is at least partially surrounded by the insulating layer, and wherein the water tank stores water supplied from an external water supply source at a predetermined temperature and provides water to the dispenser for discharge to the outside, wherein the water tank comprises a main body in which water is stored, a neck formed integrally with the main body and having a relatively narrow flow sectional area compared to that of the main body, and a nozzle installed at an end of the neck, wherein the nozzle is connected to a drainpipe of the dispenser, the main body and the neck being formed by a blow molding with the nozzle inserted therein.

9. The refrigerator as claimed in claim 8, wherein a flow sectional area of the nozzle is relatively narrower than that of the neck.

10. A refrigerator including a main body having a storage space formed therein, and a door having an insulating layer therein and rotatably coupled to the main body so as to selectively open and close the storage space, the refrigerator comprising:

a dispenser including a dispenser housing installed in a concave portion of a front surface of the door, wherein the dispenser discharges water to an outside of the refrigerator;

a water tank installed between a door liner that defines a rear surface of the door and the dispenser housing, wherein the water tank is spaced apart by a predetermined interval from each of the door liner and the dispenser housing and the water tank is at least partially surrounded by the insulating layer, and wherein the water tank stores water supplied from an external water supply source at a predetermined temperature and provides water to the dispenser for discharge to the outside; and a valve chamber provided in the insulating layer of the door and accessible from the storage space, wherein the valve chamber includes a valve that controls water supply from the external water supply source and a filter that purifies the supplied water.

11. The refrigerator as claimed in claim 10, wherein the valve chamber is selectively covered by a chamber cover.

12. A refrigerator including a main body having a storage space formed therein, and a door having an insulating layer therein rotatably coupled to the main body so as to selectively open and close the storage space, the refrigerator comprising:

a dispenser including a dispenser housing installed in a concave portion of a front surface of the door;

a water tank installed between a door liner that defines a rear surface of the door and the dispenser housing, wherein the water tank is spaced apart from the door liner and the dispenser housing by a predetermined interval, wherein the water tank stores water supplied from an external water supply source and provides the water to the dispenser;

a temperature sensor provided on a side of the water tank, wherein the temperature sensor detects a temperature in the water tank; and a heater that operates based on the temperature detected in the water tank by the temperature sensor, wherein the heater generates heat when the detected temperature is lower than a preset temperature.

13. A refrigerator including a main body having a storage space formed therein, and a door having an insulating layer therein and rotatably coupled to the main body so as to selectively open and close the storage space, the refrigerator comprising:

a dispenser including a dispenser housing installed in a concave portion of a front surface of the door, wherein the dispenser discharges water to an outside of the refrigerator;

a water tank installed between a door liner that defines a rear surface of the door and the dispenser housing, wherein the water tank is spaced apart by a predetermined interval from each of the door liner and the dispenser housing and the water tank is at least partially surrounded by the insulating layer, and wherein the water tank stores water supplied from an external water supply source at a predetermined temperature and provides water to the dispenser for discharge to the outside; and a heater installed adjacent to the water tank, wherein the heater selectively generates heat so as to maintain water stored in the water tank at or above the predetermined temperature.

14. The refrigerator as claimed in claim 13, wherein the heater is installed on a rear surface of the dispenser housing.

15. The refrigerator as claimed in claim 13, wherein the heater selectively applies heat to water stored in the water tank so as to maintain the water at or above the predetermined temperature, and the heater selectively applies heat to a surface of the dispenser housing so as to prevent accumulation of frost.

* * * * *